US005447833A

United States Patent [19]

Motoki et al.

[11] Patent Number: 5,447,833

[45] Date of Patent: Sep. 5, 1995

[54] SILVER HALIDE PHOTOGRAPHIC MATERIAL AND IMIDAZOLE DERIVATIVES

[75] Inventors: Masuji Motoki; Atsuhiro Ohkawa; Keiji Mihayashi, all of Kanagawa, Japan

[73] Assignee: Fuji Photo Film Co., Ltd., Kanagawa, Japan

[21] Appl. No.: 235,140

[22] Filed: Apr. 28, 1994

Related U.S. Application Data

[63] Continuation of Ser. No. 723,018, Jun. 28, 1991, abandoned.

[30] Foreign Application Priority Data

Jun. 28, 1990 [JP] Japan ..... 2-170832
Sep. 20, 1990 [JP] Japan ..... 2-251192

[51] Int. Cl.[6] ..... G03C 7/305

[52] U.S. Cl. ..... 430/544; 430/548; 430/559; 430/955; 430/956; 430/957; 430/958; 430/959; 430/960

[58] Field of Search ..... 430/543, 544, 548, 559, 430/564, 566, 598, 955–960

[56] References Cited

U.S. PATENT DOCUMENTS

| | | | |
|---|---|---|---|
| 4,472,493 | 9/1984 | Okamura et al. | 430/960 |
| 4,597,316 | 6/1986 | Morimoto et al. | 430/223 |
| 4,663,273 | 5/1987 | Van de Sande et al. | 430/223 |
| 4,741,997 | 5/1988 | Sato et al. | 430/223 |
| 4,770,990 | 9/1988 | Nakamura et al. | 430/223 |
| 4,818,664 | 4/1989 | Ueda et al. | 430/955 |
| 4,861,701 | 8/1989 | Burns et al. | 430/959 |
| 4,871,654 | 10/1989 | Vanmaele et al. | 430/955 |
| 4,983,494 | 6/1991 | Kitaguchi et al. | 430/960 |
| 5,034,311 | 7/1991 | Slusarek et al. | 430/544 |
| 5,071,735 | 10/1991 | Ichijima et al. | 430/544 |

FOREIGN PATENT DOCUMENTS

| | | | |
|---|---|---|---|
| 0283242 | 9/1988 | European Pat. Off. | 430/544 |
| 0383623 | 8/1990 | European Pat. Off. | 430/544 |
| 2729823 | 1/1978 | Germany | 430/223 |
| 62-136650 | 6/1987 | Japan | 430/548 |
| 63-304254 | 12/1988 | Japan | 430/544 |

OTHER PUBLICATIONS

Faul et al. RD-12841 "Process for producing positive color diffusion transfer images" Dec. 1974.

*Primary Examiner*—Charles L. Bowers, Jr.
*Assistant Examiner*—Martin J. Angebranndt
*Attorney, Agent, or Firm*—Sughrue, Mion, Zinn, Macpeak & Seas

[57] ABSTRACT

A silver halide photographic material having on a support at least one silver halide emulsion layer, which contains at least one precursor of the kind which releases at least two groups selected from the group consisting of a photographically useful group and a precursor thereof via a timing group, wherein plural photographically useful groups or precursors thereof are present on different constituent atoms of said timing group, provided that when the plural photographically useful groups have different functions, the timing group is a group which does not utilize an intramolecular nucleophilic substitution reaction.

10 Claims, No Drawings

SILVER HALIDE PHOTOGRAPHIC MATERIAL AND IMIDAZOLE DERIVATIVES

This is a Continuation of Application No. 07/723,018 filed Jun. 28, 1991, now abandoned.

FIELD OF THE INVENTION

The present invention relates to a silver halide photographic material. More particularly, the present invention relates to a precursor which can release plural molecules of a photographically useful agent per one molecule thereof.

BACKGROUND OF THE INVENTION

As for the silver halide photographic materials, particularly color photographic materials for picture-taking use, those having a high photographic speed, reduced fog and excellent keeping quality, as represented by ISO 400 photosensitive materials (e.g., Super-HG-400 manufactured by Fuji Photo Film Co., Ltd.), which can be compared favorably with ISO 100 photosensitive materials in image quality, have enjoyed an increasing demand in recent years.

One known method which can meet such a demand involves converting a photographically useful group into a precursor in which the photographically useful group is bonded to a timing group, and timely releasing the photographically useful group in the course of photographic processing. Such a method is disclosed, e.g., in U.S. Pat. Nos. 4,432,845 and 4,847,383.

In the method disclosed therein, however, one molecule of precursor releases one molecule of photographically useful group. Accordingly, incorporation of such a precursor in quantity into a film causes an increase in film thickness to result in a lowering of sharpness and a raise in cost of production.

SUMMARY OF THE INVENTION

An object of the present invention is to provide a silver halide photographic material which not only has a high photographic speed and reduced fog, or enables the reduction of development time, but also is cheap in cost of production.

The above described object of the present invention is attained by a silver halide photographic material having on a support at least one silver halide emulsion layer, which contains at least one precursor compound capable of releasing at least two groups selected from the group consisting of a photographically useful group and a precursor thereof via a timing group, wherein the plurality of photographically useful groups or precursors thereof are present on different constituent atoms of the timing group, provided that when the plurality photographically useful groups have different functions, the timing group is a group which does not utilize an intramolecular nucleophilic substitution reaction. The functions of the photographically useful groups mean those exhibited, for example, by development inhibitors, dyes, fogging agents, developers, couplers, development accelerators, desilvering accelerators, bleach accelerators or fixing accelerators.

DETAILED DESCRIPTION OF THE INVENTION

The precursor compounds of the present invention are preferably those represented by the following formula (I):

$$Q-(L_1)_l-(L_2)_m-[(L_1)_n-\mathrm{PUG}]_s \qquad \text{(I)}$$

wherein Q represents a hydrogen atom or an alkali-eliminatable group; $L_1$ represents a divalent timing group; $L_2$ represents a timing group having a valence of 3 or more; PUG represents a photographically useful group; l and n each represents 0, 1 or 2; m represents 1 or 2; and s represents a number obtained by subtracting 1 from the valence of $L_2$, being an integer of at least 2. When a plurality of $L_1$ groups or a plurality of $L_2$ groups are present in a molecule, they may be the same or different, respectively. Additionally, the plurality of PUG groups present therein may be the same or different.

In formula (I), Q represents a hydrogen atom, or an alkali-eliminatable group, with specific examples including an acyl group (e.g., acetyl, propanoyl, hexanoyl, decanoyl, 2-methylpropanoyl, phenylacetylbenzoyl, naphthoyl), a sulfonyl group (e.g., methanesulfonyl, hexanesulfonyl, benzenesulfonyl, p-toluenesulfonyl), a 2-cyanoethyl group, a 2-methanesulfonylethyl group, an alkoxycarbonyl group (e.g., methoxycarbonyl, ethoxycarbonyl, benzyloxycarbonyl) and an aryloxycarbonyl group (e.g., phenyloxycarbonyl, naphthyloxycarbonyl, p-methoxyphenyloxycarbonyl, p-nitrophenyloxycarbonyl). A group represented by Q is selected from those which do not react with an oxidized product of a developing agent, or react therewith much more slowly than the hydrolytic reaction with an alkali.

Those which are preferred as Q include a hydrogen atom, an acyl group, a sulfonyl group, an alkoxycarbonyl group and an aryloxycarbonyl group. In particular, a hydrogen atom, an acyl group and an aryloxycarbonyl group are favored over others.

As preferred examples of $L_1$ in formula (I), mention may be made of the following groups.

(1) Groups utilizing the cleavage reaction of hemiacetals:

Examples of such groups are disclosed in U.S. Pat. No. 4,146,396, JP-A-60-249148 and JP-A-60-249149 (the term "JP-A" as used herein refers to a "published unexamined Japanese patent application"), and they are represented by the following formula (T-1):

$$*\!-\!\left(W-\underset{R_{12}}{\overset{R_{11}}{C}}\right)_t\!-\!** \qquad \text{(T-1)}$$

wherein the mark * indicates the position at which Q, $L_1$ or $L_2$ of the compound represented by formula (I) is bonded; the mark ** indicates the position at which $L_1$, $L_2$ or PUG is bonded; W represents an oxygen atom, a sulfur atom, or an $$-\underset{R_{13}}{\overset{|}{N}}- \quad \text{group;}$$

$R_{11}$ and $R_{12}$ each represents a hydrogen atom or a substituent group; $R_{13}$ represents a substituent group; and t represents 1 or 2; and when t is 2, the two

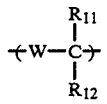

groups may be the same or different. Typical examples of $R_{11}$ and $R_{12}$, when they represent substituent groups, and $R_{13}$ include $R_{15}$—, $R_{15}CO$—, $R_{15}SO_2$—,

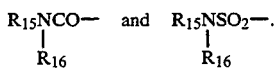

Here, $R_{15}$ represents an aliphatic or aromatic hydrocarbon residue, or a heterocyclic group; and R16 represents a hydrogen atom, an aliphatic or aromatic hydrocarbon residue, or a heterocyclic group. $R_{11}$, $R_{12}$ and $R_{13}$ each may represent a divalent group, and any two of them combine with each other to complete a ring structure. Specific examples of the group represented by formula (T-1) are illustrated below.

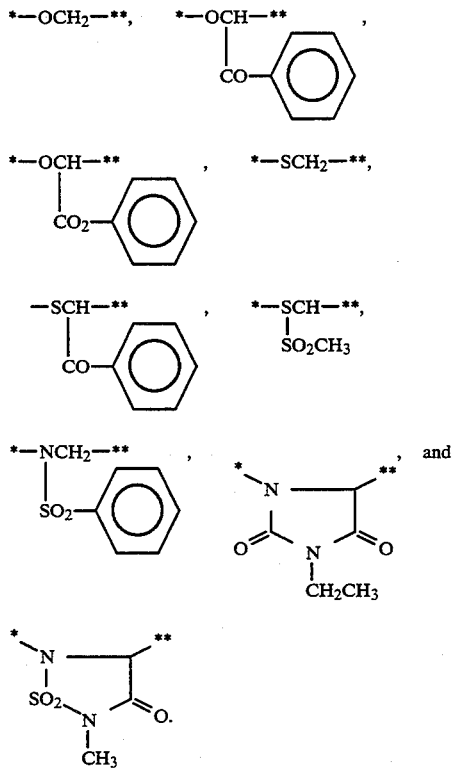

(2) Groups causing a cleavage reaction by utilizing an intramolecular nucleophilic substitution reaction:

These groups include, for example, the timing groups disclosed in U.S. Pat. No. 4,248,292. These groups can be represented by the following formula (T-2):

*—Nu—Link—E—** (T-2)

wherein Nu represents a nucleophilic group, and an oxygen or sulfur atom can be given as an example of nucleophilic species; E represents an electrophilic group being a group which is subjected to nucleophilic attack by Nu and with which the bond marked ** can be cleaved; and Link represents a linking group which enables Nu and E to have a steric arrangement such that an intramolecular nucleophilic substitution reaction can occur. Specific examples of the group represented by formula (T-2) are illustrated below.

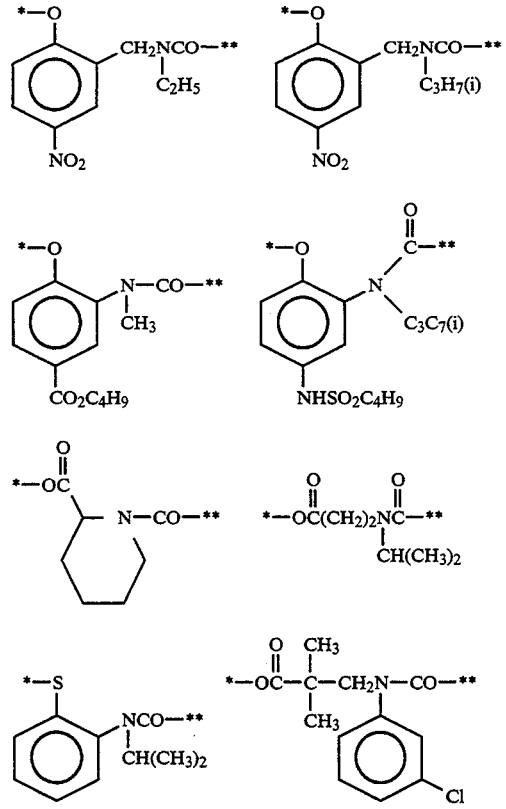

(3) Groups causing a cleavage reaction by utilizing electron transfer along a conjugated system:

Examples of such groups include the timing groups disclosed, for example, in U.S. Pat. Nos. 4,409,323, 4,421,845, JP-A-57-188035, JP-A-58-98728, JP-A-58-209736, JP-A-58-209737 and JP-A-58-209738. They are represented by the following formula (T-3):

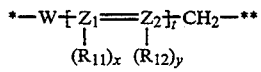

(T-3)

wherein the marks * and **, W, $R_{11}$, $R_{12}$ and t all have the same meaning as in formula (T-1), respectively. In addition, $R_{11}$ and $R_{12}$ may be joined together to form a benzene ring or a heterocyclic ring, or W may be joined with $R_{11}$ or $R_{12}$ to form a benzene or heterocyclic ring. $Z_1$ and $Z_2$ each independently represents a carbon atom or a nitrogen atom, and x and y each represents 0 or 1. More specifically, x is 1 when $Z_1$ is a carbon atom, and x is 0 when $Z_1$ is a nitrogen atom. The relationship between $Z_2$ and y is the same as that between $Z_1$ and x. Also, t represents 1 or 2. When t is 2, the two

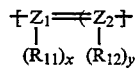

groups may be the same or different.

Specific examples of the timing group (T-3) are illustrated below.

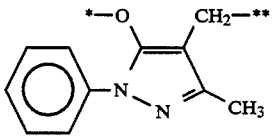

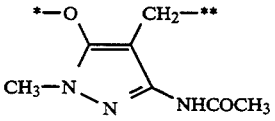

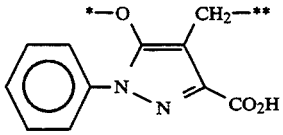

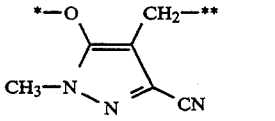

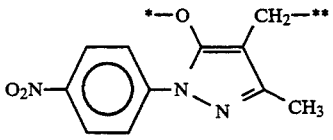

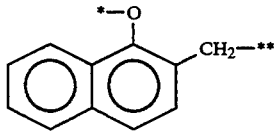

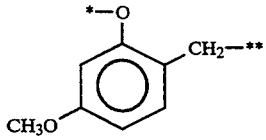

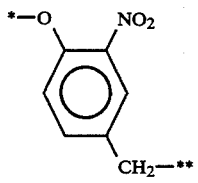

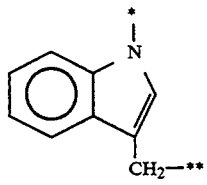

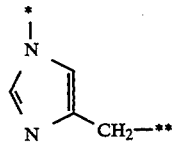

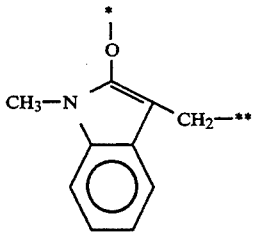

-continued

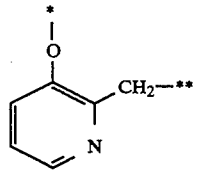

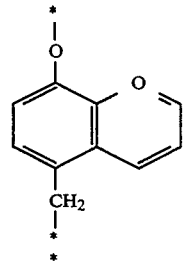

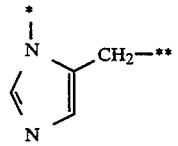

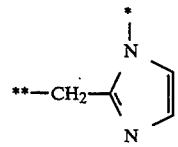

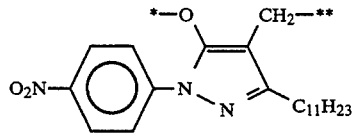

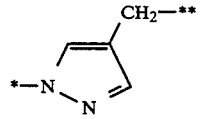

(4) Groups utilizing cleavage which takes place due to hydrolysis of esters:

Examples of such groups include the linkage groups disclosed in West German Patent Laid Open No. 2,636,315, including the groups (T-4) and (T-5) illustrated below.

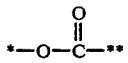

(T-4)

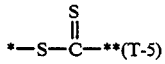

(T-5)

wherein the marks * and ** have the same meaning as in formula (T-1), respectively.

(5) Groups utilizing the cleavage reaction of iminoketals:

Examples of such groups include the linking groups disclosed in U.S. Pat. No. 4,546,073, which are represented by the following formula (T-6):

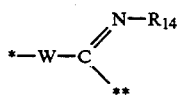

(T-6)

wherein the marks * and ** and W have the same meaning as in formula (T-1), respectively. $R_{14}$ has the same meaning as $R_{13}$ in formula (T-1). Specific examples of the group represented by formula (T-6) are illustrated below.

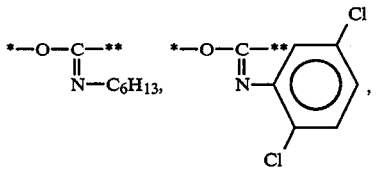

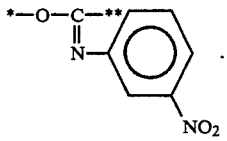

The groups which are preferred as $L_1$ are those represented by formulae (T-1) to (T-5) and those represented by formulae (T-1) and (T-4) are particularly preferred.

l is preferably 0 or 1, and n is preferably 0 or 1, and particularly preferably 0.

The group defined as $L_2$ in formula (I) represents an electron transfer type timing group having a valence of at least 3. Such a group is preferably represented by the following formula (T-$L_2$):

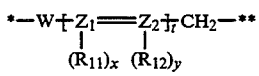

(T-$L_2$)

wherein W, $Z_1$, $Z_2$, $R_{11}$, $R_{12}$, x, y and t have the same meaning as in formula (T-3), respectively, and at least one of a plurality of $R_{11}$ or $R_{12}$ groups present is a group which is attached to —$(L_1)_n$—PUG via a substituted or unsubstituted methylene group. The mark * indicates the position at which Q-$(L_1)_l$— in formula (I) is bonded, and the mark ** indicates the position at which —$(L_1)_n$—PUG is bonded.

Groups which are preferred as (T-$L_2$) are those containing a nitrogen atom as W therein. Moreover, groups in which a 5-membered ring, especially an imidazole or pyrazole ring, is formed by combining W with $Z_2$ are more preferred.

Specific examples of the timing group represented by formula (T-$L_2$) are illustrated below. However, the present invention should not be construed as being limited to these groups.

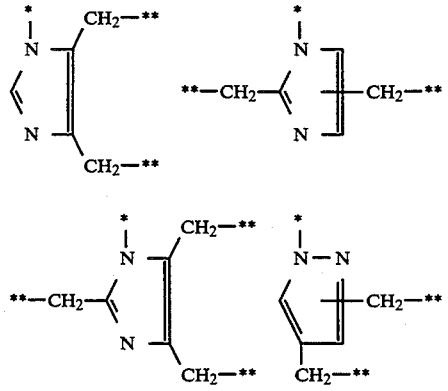

-continued

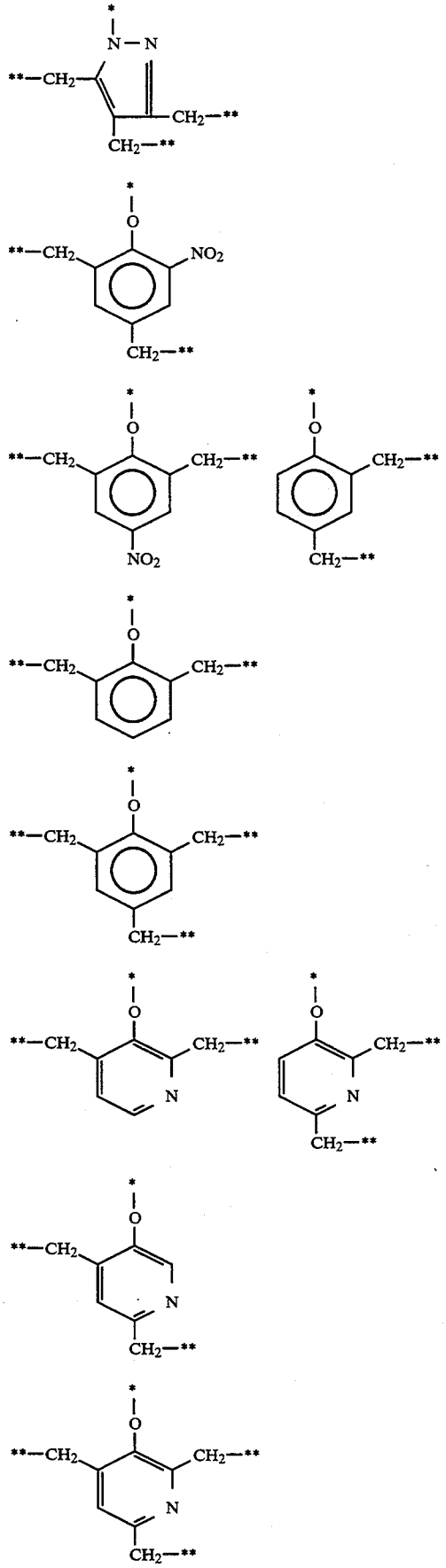

-continued

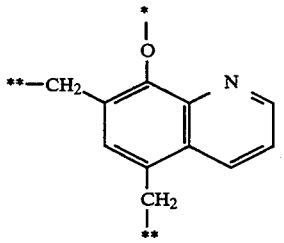

The above illustrated groups each may further have a substituent group. Suitable examples of such a substituent group include an alkyl group (e.g., methyl, ethyl, isopropyl, t-butyl, hexyl, decyl, methoxymethyl, methoxyethyl, chloroethyl, cyanoethyl, nitroethyl, hydroxypropyl, dimethylaminoethyl, benzyl, phenethyl), an aryl group (e.g., phenyl, naphthyl, 4-hydroxyphenyl, 4-cyanophenyl, 4-nitrophenyl, 2-methoxyphenyl, 2,6-dimethylphenyl, 4-t-octylphenyl, 4-t-octyloxyphenyl), a heterocyclic group (e.g., 2-pyridyl, 4-pyridyl, 2-furyl, 2-thienyl, 2-pyrrolyl), a halogen atom (e.g., chlorine, bromine), a nitro group, an alkoxy group (e.g., methoxy, ethoxy, isopropoxy), an aryloxy group (e.g., phenoxy), an alkylthio group (e.g., methylthio, isopropylthio, t-butylthio), an arylthio group (e.g., phenylthio), an amino group (e.g., amino, dimethylamino, diisopropylamino), an acylamino group (e.g., acetylamino, benzoylamino), a sulfonamido group (e.g., methanesulfonamido, benzenesulfonamido), a cyano group, a carboxyl group, an alkoxycarbonyl group (e.g., methoxycarbonyl, ethoxycarbonyl), an aryloxycarbonyl group (e.g., phenoxycarbonyl) and a carbamoyl group (e.g., N-ethylcarbamoyl, N-phenylcarbamoyl).

Among these substituents, an alkyl group, an aryl group, a nitro group, an alkoxy group, an alkylthio group, an amino group, an acylamino group, a sulfonamido group, an alkoxycarbonyl group and a carbamoyl group are preferred.

The photographically useful group represented by PUG in formula (I) includes residues of development inhibitors, dyes, fogging agents, developers, couplers, development accelerators, desilvering accelerators, bleach accelerators and fixing accelerators. Suitable examples of such photographically useful groups include the photographically useful groups disclosed in U.S. Pat. No. 4,248,962 (wherein they are represented by formula PUG), the dye residues disclosed in JP-A-62-49353 (wherein they are defined as the part of an eliminable group to be released from a coupler), residues of the development inhibitors disclosed in U.S. Pat. No. 4,477,563, and residues of the bleach accelerators disclosed in JP-A-61-201247 and JP-A-2-55 (wherein they are defined as the part of an eliminable group to be released from a coupler). In the present invention, the residues of development inhibitors are particularly preferred as photographically useful group.

Groups which are preferred as residues of development inhibitors are those represented by the following formulae (INH-1) to (INH-13):

(INH-1)

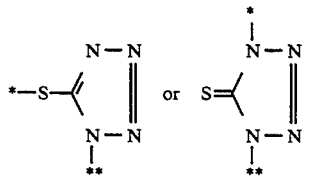

(INH-2)

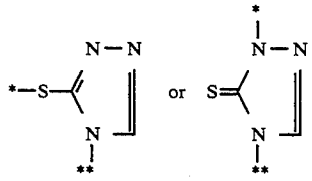

(INH-3)

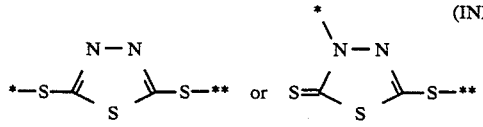

(INH-4)

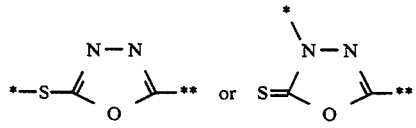

(INH-5)

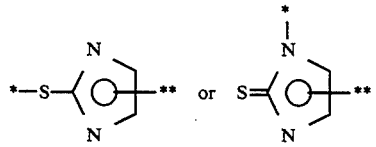

(INH-6)

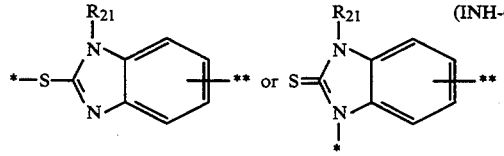

In the foregoing formulae, $R_{21}$ represents a hydrogen atom, or a substituted or unsubstituted hydrocarbon residue (e.g., methyl, ethyl, propyl, phenyl).

(INH-7)

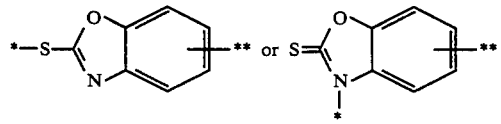

(INH-8)

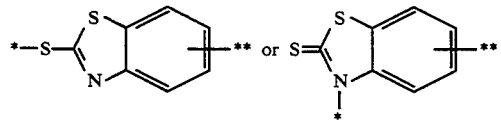

(INH-9)

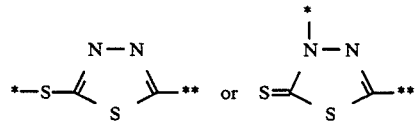

(INH-10)

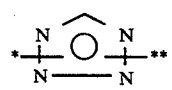

-continued (INH-11)

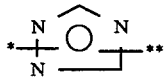

(INH-12)

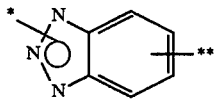

(INH-13)

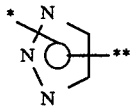

The mark * in the above illustrated formulae represents the position at which the group represented by $L_1$ or $L_2$ of the compound of formula (I) is bonded.

The mark ** therein represents the position at which a substituent group is bonded. Examples of such a substituent group include a substituted or unsubstituted alkyl, aryl and heterocyclic groups. In these substituent groups, it is desirable that a group which decomposes in a processing solution upon photographic processing should be contained.

Specific examples of an alkyl group suitable for the foregoing substituent group include methyl, ethyl, propyl, butyl, hexyl, decyl, isobutyl, t-butyl, 2-ethylhexyl, benzyl, 4-methoxybenzyl, phenethyl, propyloxycarbonylmethyl, 2-(propyloxycarbonyl)ethyl, butyloxycarbonylmethyl, pentyloxycarbonylmethyl, 2-cyanoethyloxycarbonylmethyl, 2,2-dichloroethyloxycarbonylmethyl, 3-nitropropyloxycarbonylmethyl, 4-nitrobenzyloxycarbonylmethyl and 2,5-dioxo-3,6-dioxadecyl. Specific examples of an aryl group suitable for the foregoing substituent group include phenyl, naphthyl, 4-methoxycarbonylphenyl, 4-ethoxycarbonylphenyl, 3-methoxycarbonylphenyl and 4-(2-cyanoethyloxycarbonyl)phenyl.

Specific examples of a heterocyclic group suitable for the foregoing substituent group include 4-pyridyl, 3-pyridyl, 2-pyridyl, 2-furyl and 2-tetrahydropyranyl.

Among the foregoing residues of development inhibitors, (INH-1), (INH-2), (INH-3), (INH-4), (INH-9) and (INH-12) are preferred for INH, and (INH-1), (INH-2) and (INH-3) are particularly preferred.

In addition, bis-bodies represented by the following formula (I-B) are included in the compounds of the present invention:

$$Q'\{(L_1)_l-(L_2)_m[(L_1)_n PUG]_s\}_2 \quad \text{(I-B)}$$

wherein $L_1$, $L_2$, PUG, l, m, n and s have the same meaning as in formula (I), respectively; and Q′ represents

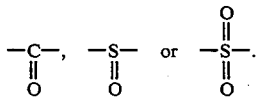

Compounds which are most preferred as the precursor of the present invention are imidazole derivatives represented by the following formula (A):

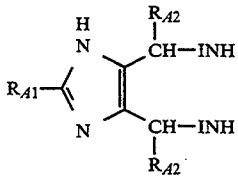

(A)

In the above formula, $R_{A1}$ represents a hydrogen atom, an aryl group containing 6 to 12 carbon atoms, an alkyl group containing 1 to 10 carbon atoms, or a cycloalkyl group. Groups which are preferred as $R_{A1}$ include a hydrogen atom, an alkyl group containing 1 to 6 carbon atoms and a phenyl group.

In the foregoing formula (A), $R_{A2}$ represents a hydrogen atom, an alkyl group containing 1 to 6 carbon atoms or a phenyl group. The two $R_{A2}$ groups may be joined together to form a ring. Groups which are preferred as $R_{A2}$ include a hydrogen atom, a methyl group, an ethyl group and a phenyl group. Among them, a hydrogen atom is particularly preferred.

INH in formula (A) represents a residue of a development inhibitor, which has the same meaning as illustrated in formula (I), giving suitable examples. A plurality of $R_{A2}$ groups and INH groups may be the same or different, respectively.

Now, specific examples of the precursor of the present invention are illustrated below. However, the present invention should not be construed as being limited to these examples.

(1)
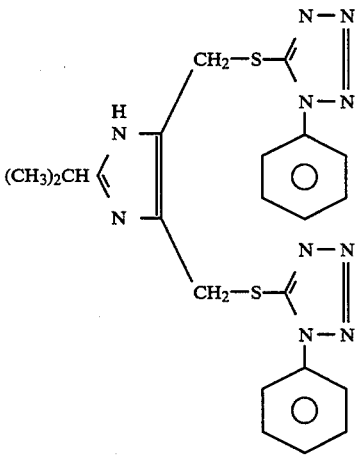
(2)
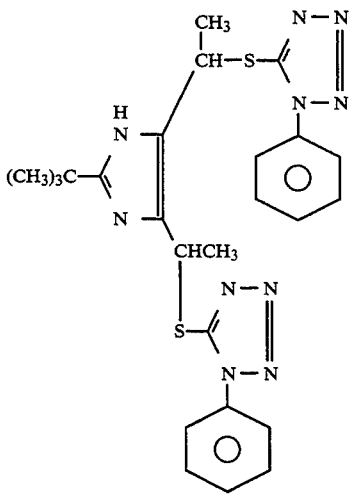
(3)
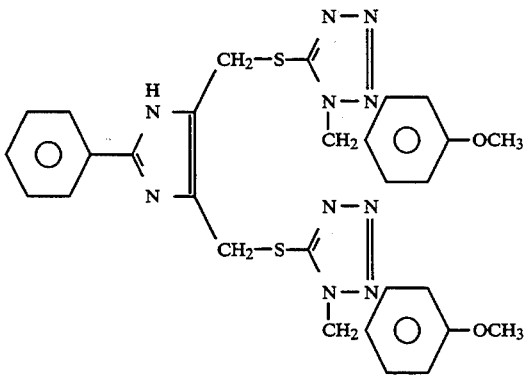
(4)
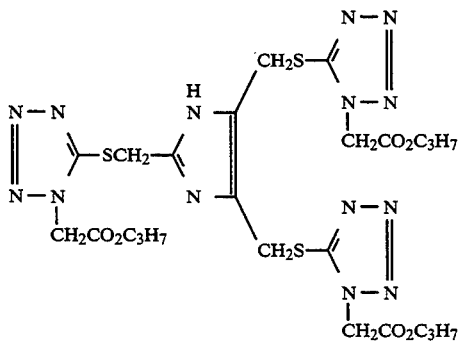
(5)
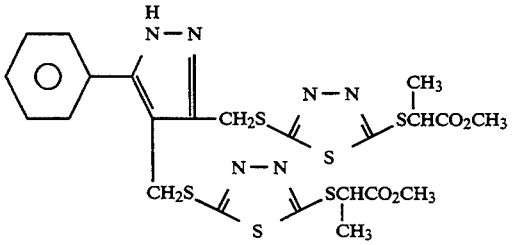
(6)
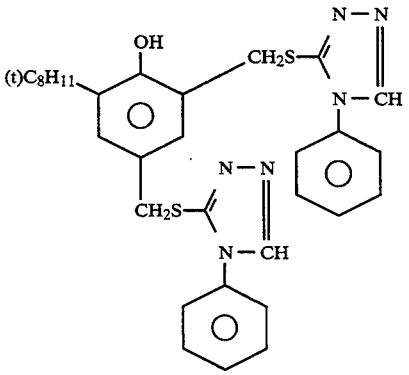

-continued
(7)
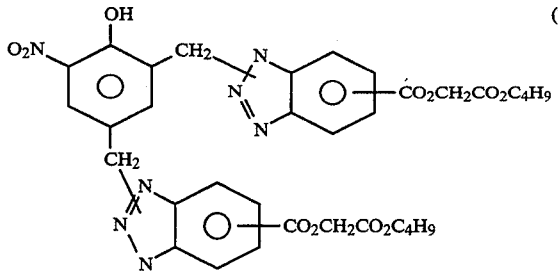
(8)
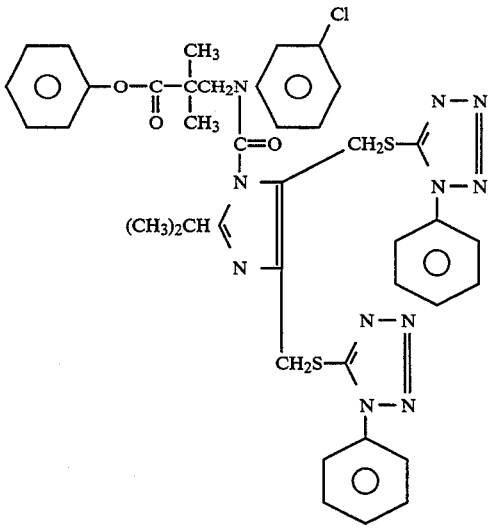
(9)
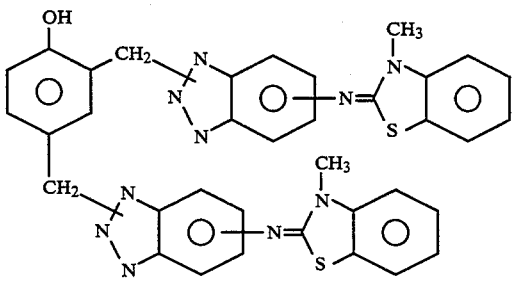
(10)
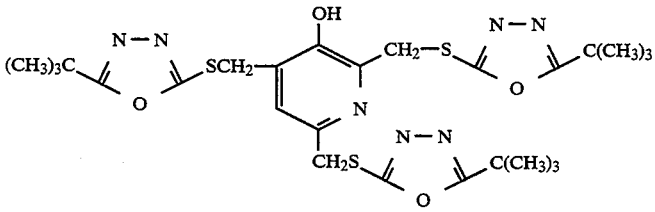
(11)
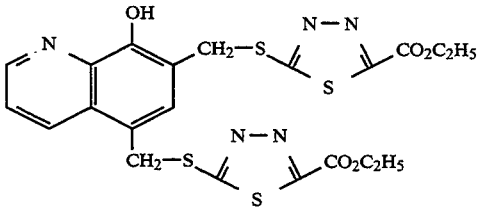
(12)
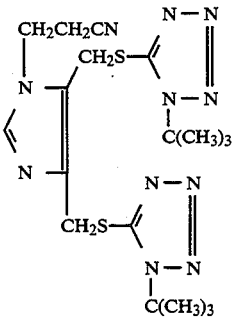

-continued
(13)
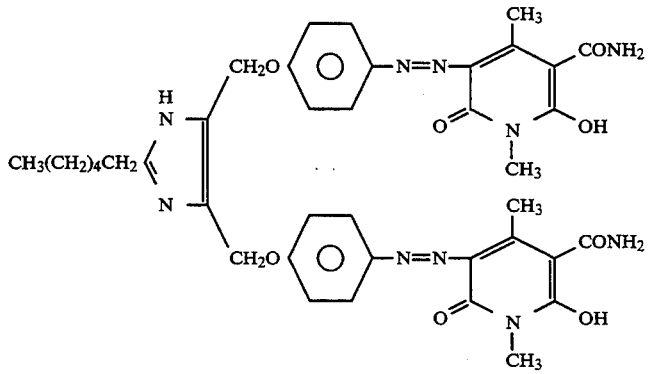
(14)
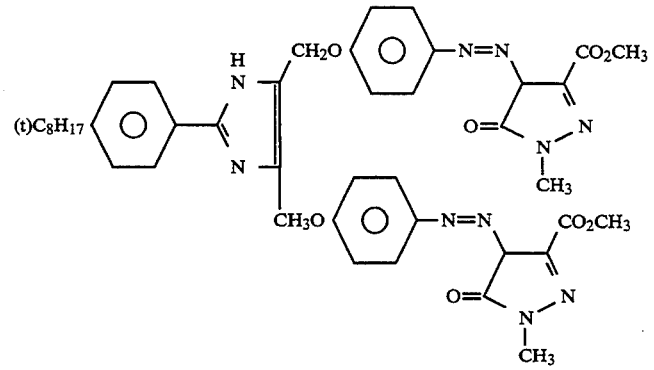
(15)
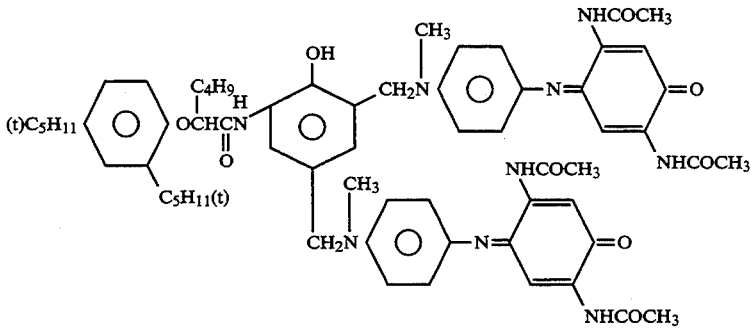
(16)
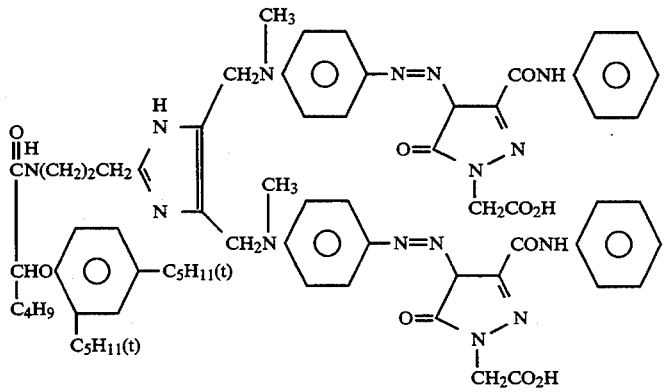

-continued
(17)
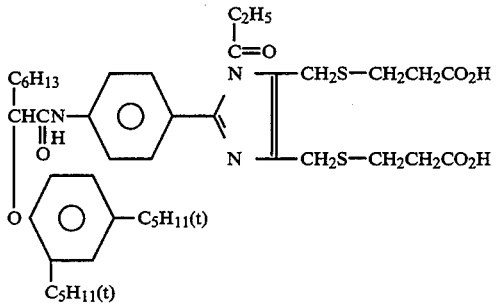
(18)
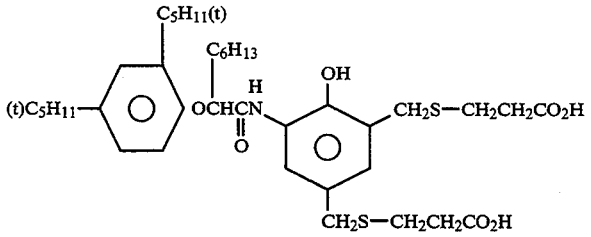
(19)
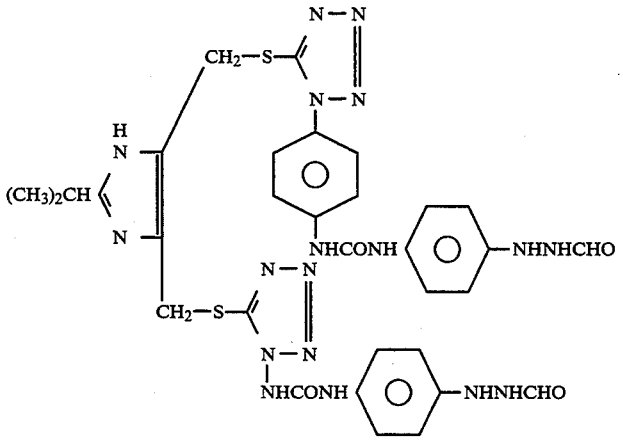
(20)
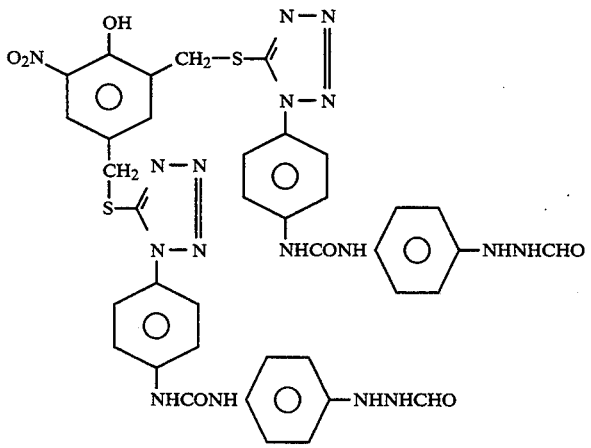

-continued
(21)
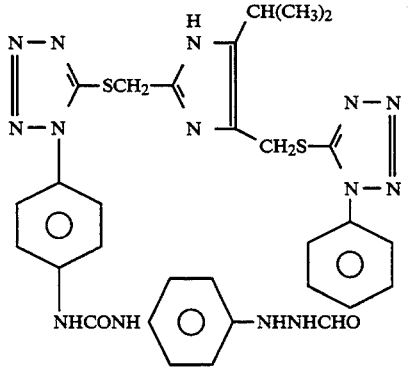
(22)
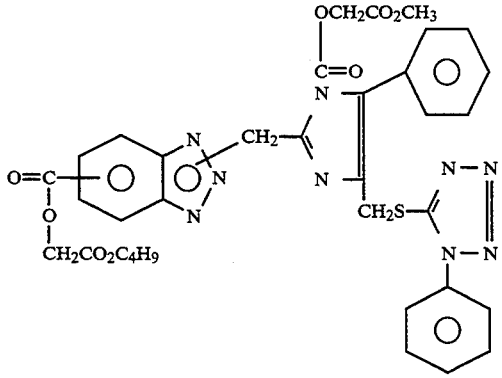
(23)
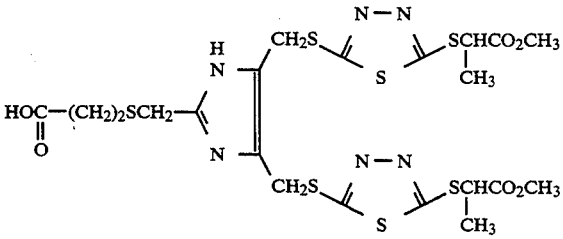
(24)
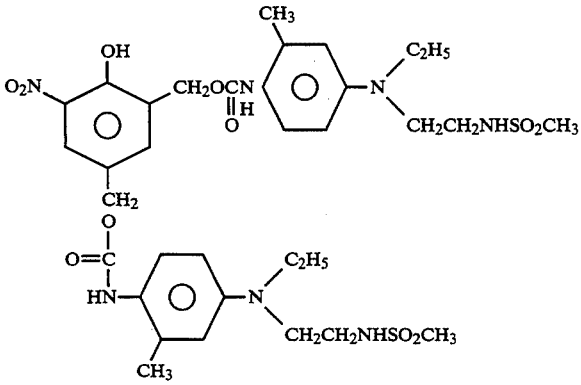
(25)
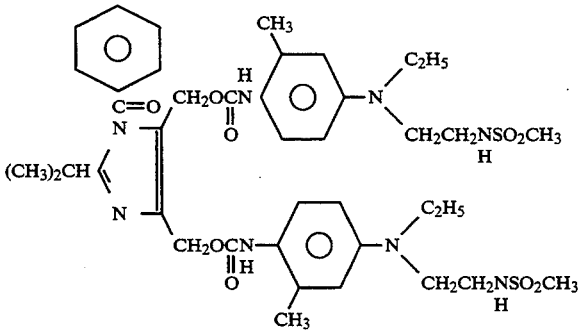

-continued
(26)
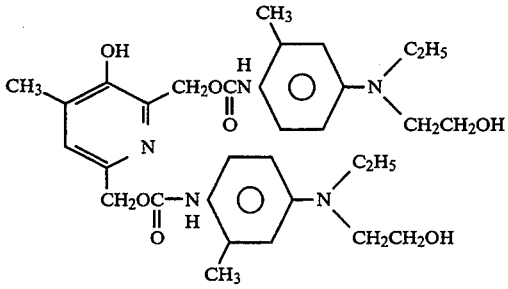
(27)
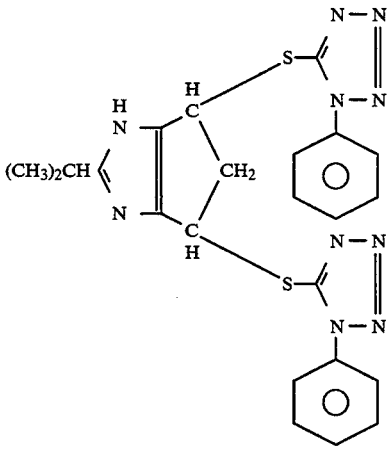
(28)
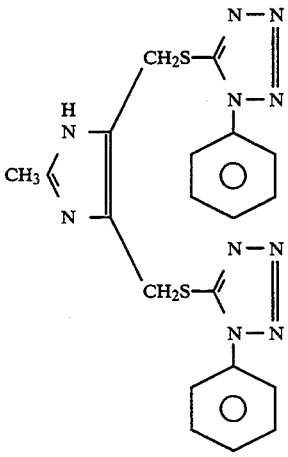
(29)
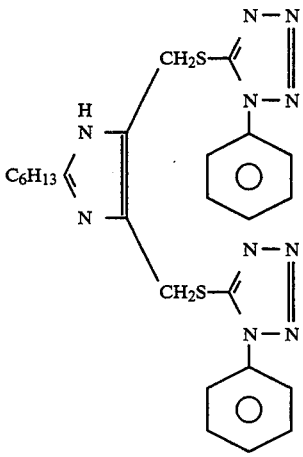
(30)
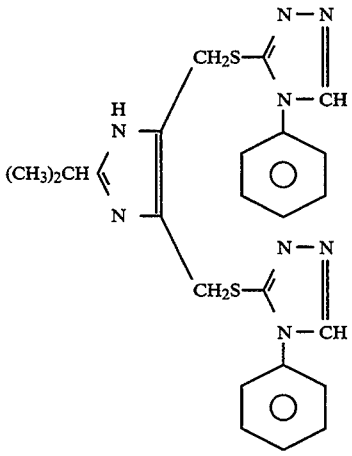
(31)
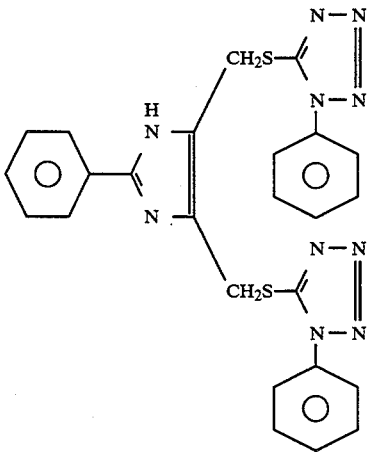

-continued
(32)
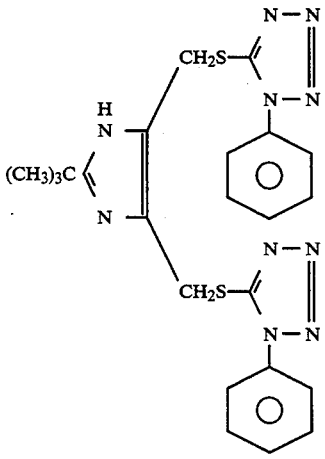
(33)
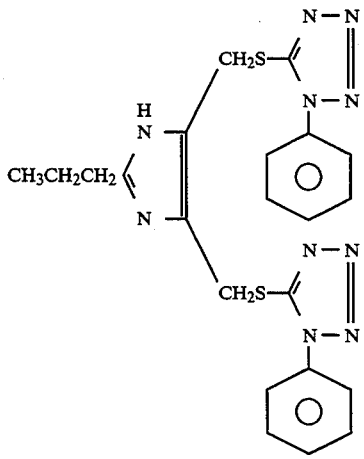
(34)
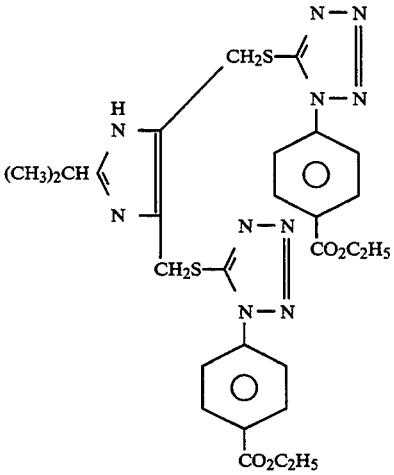
(35)
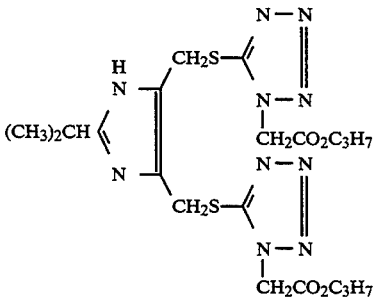
(36)
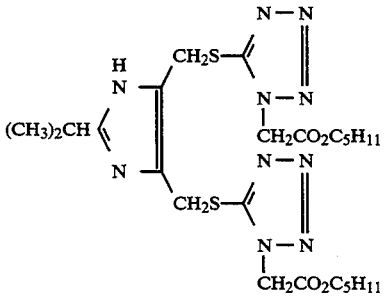
(37)
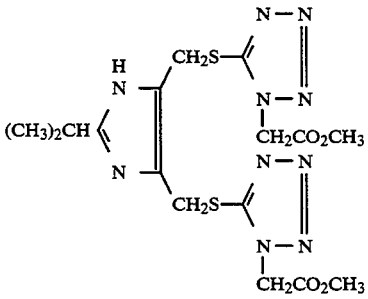
(38)
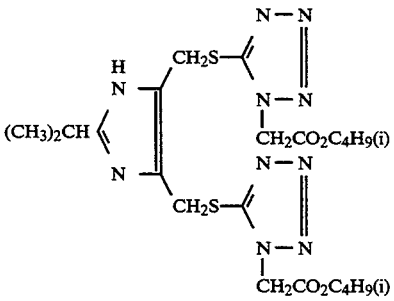
(39)
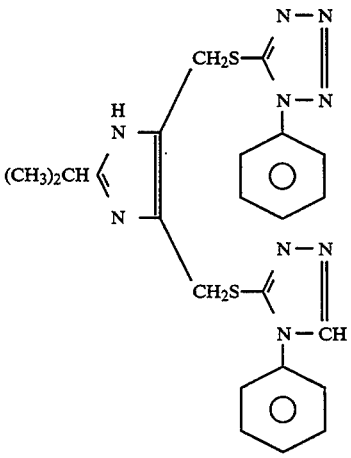

-continued (40)

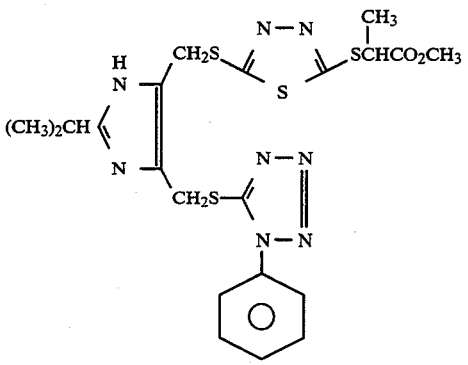

(41)

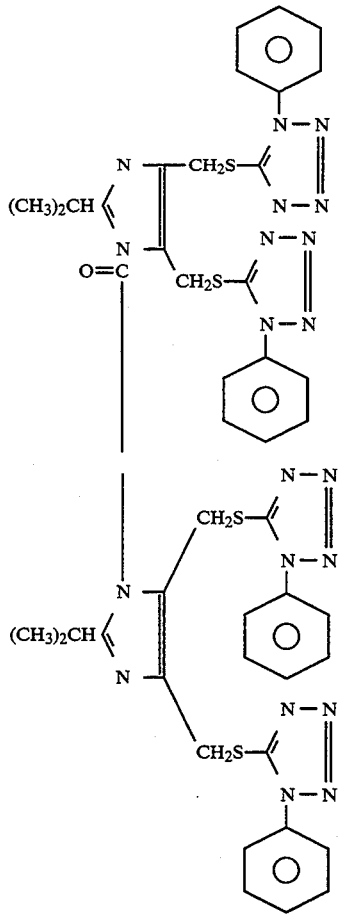

(42)

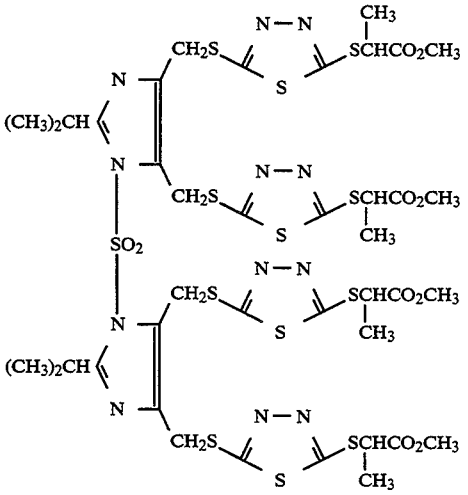

(43)

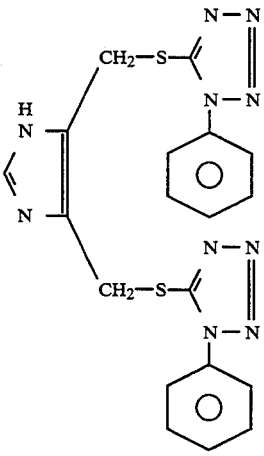

The precursor compounds of the present invention can be synthesized with ease in a process which comprises converting the diol or polyol of a timing group into the halide by the reaction with, for example, thionyl chloride, phosphorus trichloride, phosphorus pentachloride, thionyl bromide and phosphorus tribromide, and then allowing the resulting halide to react with a photographically useful compound or its derivative; or in a process which comprises converting the diol or polyol of a timing group into the active ester by the reaction with methinesulfonyl chloride or ethyl chlorocarbonate, and then allowing the resulting ester to react with a photographically useful compound.

Typical synthesis examples of the precursor compounds of the present invention are illustrated below.

SYNTHESIS EXAMPLE (a)

Synthesis of Compound (1)

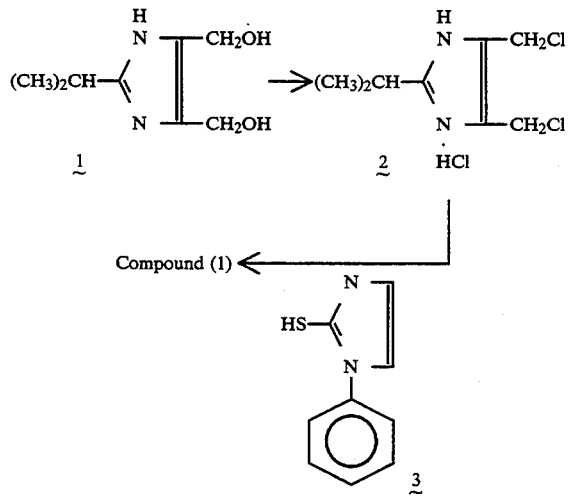

Thionyl chloride (15 ml) was slowly added dropwise to Compound 1 (3.4 g), and then heated at 60° C. for 2 hours to complete the reaction. Excess thionyl chloride was distilled away under reduced pressure to obtain crude crystals of Compound 2. Thereafter, N,N-diisopropylethylamine (7.9 g) was added to a suspension of Compound 3 (3.4 g) in N,N-dimethylformamide (DMF, 20 ml), and thereto was further added a solution of Compound 2 in DMF (20 ml). The temperature of the mixture was kept at room temperature for 1 hour to complete the reaction. The resulting reaction mixture was poured into water (150 ml) to precipitate crystals, which were then filtered off, dried under reduced pressure, and recrystallized from an ethyl acetate-hexane mixture to obtain 4.9 g of Compound (1) (in a 72% yield). Melting Point: 144°-145° C.

SYNTHESIS EXAMPLE (b)

Synthesis of Compound (28)

Compound (28) was synthesized and purified in the same manner as in Synthesis Example (a). Melting Point: 96°-98° C.

SYNTHESIS EXAMPLE (c)

Synthesis of Compound (32)

Compound (32) was synthesized and purified in the same manner as in Synthesis Example (a). Melting Point: 78° C.

SYNTHESIS EXAMPLE (d)

Synthesis of Compound (35)

Compound (35) was synthesized in the same manner as in Synthesis Example (a), and the purification thereof was carried out as follows: The oily matter obtained by pouring the reaction mixture into water was extracted with ethyl acetate, and the organic solvent phase obtained was thoroughly washed with water, concentrated, and then passed through a column of silica gel (eluent: ethyl acetate-hexane 4/1 (by volume) mixture). Thus, the desired compound was obtained.

$^1$H-NMR ($CDCl_3+CD_3OD$):

$\delta$=0.90 (6H), 1.35 (6H), 1.70 (4H), 3.10 (1H), 4.20 (4H), 4.60 (4H), and 5.05 (4H).

SYNTHESIS EXAMPLE (e)

Synthesis of Compound (36)

Compound (36) was synthesized and purified in the same manner as in Synthesis Example (d). The resulting compound was an oily substance.

$^1$H-NMR ($CDCl_3+CD_3OD$):

$\delta$=0.90 (6H), 1.35 (14H), 1.65 (4H), 3.10 (1H), 4.20 (4H), 4.60 (4H), and 5.00 (4H).

SYNTHESIS EXAMPLE (f)

Synthesis of Compound (37)

Compound (37) was synthesized and purified in the same manner as in Synthesis Example (d). The resulting compound was an oily substance.

$^1$H-NMR ($CDCl_3+CD_3OD$):

$\delta$=1.30 (6H), 3.00 (1H), 3.80 (6H), 4.55 (4H) and 5.05 (4H).

SYNTHESIS EXAMPLE (g)

Synthesis of Compound (38)

Compound (38) was synthesized and purified in the same manner as in Synthesis Example (d). The resulting compound was an oily substance.

$^1$H-NMR ($CDCl_3+CD_3OD$):

$\delta$=0.90 (12H), 1.30 (6H), 1.95 (2H), 3.10 (1H), 4.00 (4H), 4.60 (4H), and 5.05 (4H).

When photographically useful groups in the precursor compound of the present invention are residues of development inhibitors or fogging agents, the precursor compound is incorporated into a photosensitive material in an amount ranging generally from $1\times10^{-7}$ to $1\times10^{-2}$ mol/m$^2$, preferably from $1\times10^{-6}$ to $1\times10^{-3}$ mol/m$^2$ and more preferably from $5\times10^{-6}$ to $2\times10^{-4}$ mol/m$^2$. When they are residues of development accelerators, desilvering accelerators or developers, the precursor compound is incorporated in an amount ranging generally from $5\times10^{-7}$ to $2\times10^{-1}$ mol/m$^2$, preferably from $5\times10^{-6}$ to $5\times10^{-3}$ mol/m$^2$, and more preferably from $2\times10^{-5}$ to $1\times10^{-3}$ mol/m$^2$. When they are residues of dyes, the precursor compound is incorporated in an amount ranging generally from $1\times10^{-6}$ to $3\times10^{-2}$ mol/m$^2$, preferably from $1\times10^{-5}$ to $5\times10^{-3}$ /m$^2$, and more preferably from $5\times10^{-5}$ to $2\times10^{-3}$ mol/m$^2$.

A photographic material containing the precursor compound of the present invention comprises a support having thereon at least one of each of blue-sensitive, green-sensitive and red-sensitive silver halide emulsion layers. These silver halide emulsion layers and other light-insensitive layers have no any particular restrictions as to the number of constituent layers and the arranging order. A typical silver halide photographic material is a silver halide photographic material having on a support at least one light-sensitive layer consisting of two or more of silver halide emulsion layers which have substantially the same color sensitivity but different photographic speed and the light-sensitive layer is a light-sensitive layer unit having color sensitivity to any of blue light, green light and red light. As for the arranging order of these light-sensitive layer unit in a multilayer silver halide color photographic material, it is general to arrange a support, a red-sensitive layer, a green-sensitive layer and a blue-sensitive layer, in this order from the support side. However, the above described order may be reversed, if needed. Also, it is possible to take an arranging order that constituent layers having the same color sensitivity hold a light-sensitive layer having different color sensitivity therebetween.

Moreover, the light-insensitive layers including various kinds of intermediate layers may be provided between the silver halide light-sensitive layers, and as an uppermost layer and a lowermost layer.

The intermediate layers may contain couplers and DIR compounds, for example, as those disclosed in JP-A-61-43748, JP-A-59-113438, JP-A-59-113440, JP-A-61-20037 and JP-A-61-20038, and they may also contain generally used color stain inhibitor.

Plural silver halide emulsion layers which constitute each light-sensitive layer unit can preferably assume a two-layer structure consisting of a high speed emulsion layer and a slow speed emulsion layer, as disclosed in West German Patent 1,121,470 or British Patent 923,045. In general, it is preferred to arrange the constituent layers of a light-sensitive layer unit so that the photographic speed may decrease in the direction of the support. Also, a light-insensitive layer may be sandwiched between constituent layers of each light-sensitive layer unit. On the other hand, it is also possible to dispose a slow speed emulsion layer on the side farthest away from the support and to dispose a high speed emulsion layer on the side closest to the support, as disclosed, e.g., in JP-A-57-112751, JP-A-62-200350, JP-A-62-206541 and JP-A-62-206543.

More specifically, the arrangement may be from the side farthest from the support, a slow speed blue-sensitive layer (BL), a high speed blue-sensitive layer (BH), a high speed green-sensitive layer (GH), a slow speed green-sensitive layer (GL), a high speed red-sensitive layer (RH) and a slow speed red-sensitive layer (RL), or BH/BL/GL/GH/RH/RL or BH/BL/GH/GL/RL/RH.

In addition, the layers can be arranged in the order, from the side farthest from the support, of blue-sensitive layer/GH/RH/GL/RL as disclosed in JP-B-55-34932 (the term "JP-B" as used herein refers to an "examined Japanese patent publication"). In addition, the layers can also be arranged in the order, from the side farthest from the support, of blue-sensitive layer/GL/RL/GH/RH/support as disclosed in JP-A-56-25738 and JP-A-62-63936.

There are also arrangements in which there are three layers which have different photographic speeds with the photographic speed decreasing stepwise towards the support with the silver halide emulsion layer of the highest speed as an uppermost layer, a silver halide emulsion layer having a speed lower than that of the uppermost layer as an intermediate layer, and a silver halide emulsion layer having a speed lower than that of the intermediate layer as the lowermost layer, as disclosed in JP-B-49-15495. In the similar case, wherein the light-sensitive layer unit has a structure of three layers with different speed, the layers in a layer unit of the same color sensitivity may be arranged in the order, from the side farthest from the support, of a medium speed emulsion layer, a high speed emulsion layer and a low speed emulsion layer, as disclosed in JP-A-59-202464.

In addition, an arranging order of high speed emulsion layer/low speed emulsion layer/medium speed emulsion layer, or an arranging order of low speed emulsion layer/medium speed emulsion layer/high speed emulsion layer may be adopted.

Also, in the case where a light-sensitive layer unit comprises four or more layers, the layer arrangement can be chosen and altered similarly.

As described above, various layer structures and arrangements can be selected according to the purpose of the photographic material.

The preferred silver halides contained in photographic emulsion layers of the photographic light-sensitive material of the present invention are silver iodobromide, iodochloride or iodochlorobromide having an iodide content of about 30 mol% or less. Particularly preferred silver halide is silver iodobromide or iodochlorobromide having an iodide content of from about 2 mol% to about 10 mol%.

Silver halide grains in the photographic emulsions may have a regular crystal form, such as a cubic, octahedral, tetradecahedral form, an irregular crystal form, such as a spherical or tabular form, a form which has crystal defects, such as twinned crystal planes, or a form which has a composite of these forms.

The silver halide grains may be fine grains having a size of about 0.2 μm or less, or large ones having a projected area-corresponding diameter up, to about 10 μm, and the emulsions may be monodispersed emulsions and polydispersed emulsions.

Silver halide photographic emulsions usable in the present invention can be prepared using known methods described, for example, in *Research Disclosure* (RD), No. 17643, pages 22 and 23, "I. Emulsion Preparation and Types" (December, 1978); *Research Disclosure,* No. 18716, page 648 (November, 1979) and *Research Disclosure,* No. 307105, pages 863 to 865 (November, 1989); P. Glafkides, *Chimie et Physique Photographique,* Paul Montel, Paris (1967); G. F. Duffin, *Photographic Emulsion Chemistry,* The Focal Press, London (1966); V. L. Zelikman et al, *Making and Coating Photographic Emulsion,* The Focal Press, London (1964), and so on.

The monodispersed emulsions disclosed, for example, in U.S. Pat. Nos. 3,574,628 and 3,655,394, and British Patent 1,413,748 are also desirable.

Also, tabular grains with an aspect ratio of at least about 3 can be used in the present invention. Such tabular grains can be prepared with ease in accordance with methods as described, for example, in Gutoff, *Photographic Science and Engineering,* Vol. 14, pages 248 to 257 (1970), U.S. Pat. Nos. 4,434,226, 4,414,310, 4,433,048 and 4,439,520, British Patent 2,112,157, and so on.

The crystal structure of the grains may be uniform throughout, or the interior and exterior parts of the grains may have different halogen composition, or the grains may have a layer-like structure. Further, silver halide grains in which crystal surfaces differing in halogen composition are fused together through epitaxial growth, or emulsion grains in which silver halide grains are fused together with a salt other than silver halide, such as silver thiocyanate, lead oxide or the like may be used. A mixture of grains with various crystal forms may be used.

The above mentioned emulsions may be of the surface latent image type in which a latent image is formed predominantly on the surface of the grains, or the internal latent image which mainly forms latent image inside the grains, and those type in which the latent image is formed both on the surface and within the grains, but in all the above cases, a negative type emulsions is necessary. Among the internal latent image types, the emulsions may be a core/shell internal latent image type emulsion as disclosed in JP-A-63-264740. A process of preparing such a core/shell internal latent image type emulsions is disclosed in JP-A-59-133542. A suitable thickness of the shell of the emulsion differs, for example, according to the condition of development processing, but is preferably from 3 to 40 nm, particularly from 5 to 20 nm.

Silver halide emulsions which have undergone physical ripening, chemical sensitization and spectral sensitization treatments are generally used. Additives used in these steps are described in *Research Disclosure,* Nos. 17643, 18716 and 307105, and pages on which they are described are summarized in the table shown hereinafter.

In a photographic material which contains the precursor of the present invention, two or more different light-sensitive silver halide emulsions which differ in at least one of the characteristics of grain size, grain size distribution, halogen composition, grain form or photographic speed can be used in the form of a mixture in the same layer.

Surface-fogged silver halide grains disclosed in U.S. Pat. No. 4,082,533, interior-fogged silver halide grains disclosed in U.S. Pat. No. 4,626,498 and JP-A-59-214852, or colloidal silver can preferably be used in light-sensitive silver halide emulsion layers and/or hydrophilic colloid layers which are substantially insensitive to light. The expression "surface- or interior-fogged silver halide grains" as used herein signifies silver halide grains of the kind which are all uniformly (non-imagewise) developable irrespective of whether they are present in the unexposed part of the photographic material or in the exposed part thereof. Processes of preparing the interior- or surface-fogged silver halide grains are disclosed in U.S. Pat. No. 4,626,498, and JP-A-59-214852.

The silver halide which forms the internal nuclei of interior-fogged core/shell type silver halide grains may have the same halogen composition or a different halogen composition. The interior- or surface-fogged silver halide can include any of silver chloride, silver chlorobromide, silver iodobromide, and silver chloroiodobromide. These fogged silver halide grains are not particularly restricted as to grain size, bug it is desirable that they should have an average grain size of from 0.01 to 0.75 μm, especially from 0.05 to 0.6 μm. Additionally, such grains are not particularly restricted as to grain form also. That is, they may have a regular form, and they may be polydisperse, but preferably are monodisperse (the terminology monodisperse as used herein refers to a disperse wherein at least 95%, by weight or number, of the grains have their individual sizes within ±40% of the average grain diameter).

In a photographic material which contains the precursor of the present invention, it is preferred that light-insensitive fine grain silver halide should be used. The term "light insensitive fine grain silver halide" refers to the fine grains of silver halide which are not sensitive to light upon imagewise exposure for forming dye images, and are substantially not developed upon development. It is preferable for such fine grains to be not fogged in advance.

The fine grain silver halide has a bromide content of from 0 to 100 mol% and, if necessary, may contain silver chloride and/or silver iodide. Preferably, the iodide content is from 0.5 to 10 mol%.

An average grain diameter (the average of diameters of the circles equivalent to projection areas of the grains) of the fine grain silver halide is preferably within the range of 0.01 to 0.5 μm, and more preferably is from 0.02 to 0.2 μm.

The fine grain silver halide can be prepared using the same methods as general light-sensitive silver halides. In the course of the preparation, however, the grain surface requires neither optical sensitization nor spectral sensitization. In preparing a coating composition containing the fine grain silver halide, it is to be desired that a stabilizer, such as a triazole compound, an azaindene compound, a benzothiazolium compound, a mercapto compound or a zinc compound, should be added to the coating composition prior to the addition of fine grain silver halide. In the layer containing the fine grain silver halide, colloidal silver can be incorporated to advantage.

A suitable silver coverage of the photographic material of the present invention is not more than 6.0 g/m$^2$, particularly not more than 4.5 g/m$^2$.

In addition, other known photographic additives usable in the present invention are described in the above mentioned three *Research Disclosures,* and set forth together in the following table.

| Kind of Additives | RD 17643 (December, 1978) | RD 18716 (November, 1979) | RD 307105 (November, 1989) |
|---|---|---|---|
| 1. Chemical Sensitizers | Page 23 | Page 648, right column | Page 866 |
| 2. Sensitivity Increasing Agents | — | " | — |
| 3. Spectral Sensitizers and Supersensitizers | Pages 23–24 | Page 648, right column to page 649, right column | Pages 866–868 |
| 4. Brightening Agents | Page 24 | Page 647, right column | Page 868 |
| 5. Antifoggants and Stabilizers | Pages 24–25 | Page 649, right column | Pages 868–870 |
| 6. Light Absorbers, Filter Dyes and Ultraviolet Absorbers | Pages 25–26 | Page 649, right column to page 650, left column | Page 873 |
| 7. Stain Inhibitors | Page 25, right column | Page 650, left to right columns | Page 872 |
| 8. Dye Image Stabilizers | Page 25 | Page 650, left column | Page 872 |
| 9. Hardeners | Page 26 | Page 651, left column | Pages 874–875 |
| 10. Binders | Page 26 | " | Pages 873–874 |
| 11. Plasticizers and Lubricants | Page 27 | Page 650, right column | Page 876 |
| 12. Coating Aids and Surface Active Agents | Pages 26–27 | " | Pages 875–876 |
| 13. Antistatic Agents | Page 27 | " | Pages 876–877 |
| 14. Matting Agents | — | — | Pages 878–879 |

In order to prevent photographic properties from deteriorating due to formaldehyde gas, it is desirable that a compound capable of reacting with and fixing formaldehyde gas, as disclosed in U.S. Pat. Nos. 4,411,987 and 4,435,503, should be incorporated in the photographic material.

Also, it is desirable that the photographic material of the present invention should contain a mercapto compound as disclosed in U.S. Pat. Nos. 4,740,454, 4,788,132, JP-A-62-18539 and JP-A-1-283551.

Further, it is desirable that the photographic material of the present invention should contain, as disclosed in JP-A-1-106052, a fogging agent, a development accelerator and a silver halide solvent, or precursors thereof, irrespective of the quantity of developed silver which the photographic material can produce by development processing.

Furthermore, it is desirable that the photographic material of the present invention should contain a dye dispersion prepared in the process disclosed in WO 88/04794 or JP-A-1-502912, or the dyes disclosed in EP-A-0317308, U.S. Pat. No. 4,420,555, or JP-A-1-259358.

Various kinds of color couplers can be used in the present invention also, and specific examples thereof are disclosed in the patents cited in the foregoing RD, No. 17643 (Items VII-C to VII-G) and RD, No. 307105 (Items VII-C to VII-G).

As the yellow couplers, those disclosed, e.g., in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649, and EP-A-0249473 are preferred.

As the magenta couplers, 5-pyrazolone compounds and pyrazoloazole compounds are preferred. In particular, those disclosed in U.S. Pat. Nos. 4,310,619 and 4,351,897, European Patent 73,636, U.S. Pat. Nos. 3,061,432 and 3,725,064, *Research Disclosure,* No. 24220 (June, 1984), JP-A-60-33552, *Research Disclosure,* No. 24230 (June, 1984), JP-A-60-43659, JP-A-61-72238, JP-A-60-35730, JP-A-55-118034, JP-A-60-185951, U.S. Pat. Nos. 4,500,630, 4,540,654 and 4,556,630, WO 88/04795 can be used to advantage.

Cyan couplers which can be preferably used include those of phenol and naphthol types, as disclosed, e.g., in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,729, EP-A-0121365, EP-A-0249453, U.S. Pat. Nos. 3,446,622, 4,333,999, 4,775,616, 4,451,559, 4,427,767, 4,690,889, 4,254,212 and 4,296,199, and JP-A-61-42658. In addition, the pyrazoloazole type couplers disclosed in JP-A-64-553, JP-A-64-554 and JP-A-64-555, and the imidazole type couplers disclosed in U.S. Pat. No. 4,818,672 can be used to advantage.

Typical examples of polymerized dye forming couplers are disclosed, e.g., in U.S. Pat. Nos. 3,451,820, 4,080,211, 4,367,282, 4,409,320 and 4,576,910, British Patent 2,102,173, and EP-A-0341188.

As the couplers which can form colored dyes having a suitable moderate diffusibility, those disclosed in U.S. Pat. 4,366,237, British Patent 2,125,570, European Patent 96,570, West German Patent Application (OLS) No. 3,234,533 are preferred.

As the colored couplers for correcting unnecessary absorptions of the colored dyes, those disclosed, e.g., in *Research Disclosure,* No. 17643 (Item VII-G), *Research Disclosure,* No. 307105 (Item VII-G), U.S. Pat. Nos. 4,163,670, JP-B-57-39413, U.S. Pat. Nos. 4,004,929 and 4,138,258, and British Patent 1,146,368 are preferred. In addition, it is desirable to use the couplers capable of correcting unnecessary absorptions of the colored dyes by fluorescent dyes released upon coupling reaction, which are disclosed in U.S. Pat. No. 4,774,181; and the couplers having as a splitting-off group a dye precursor moiety capable of forming a dye by the reaction with a color developing agent, which are disclosed in U.S. Pat. No. 4,777,120.

Also, couplers capable of releasing a photographically useful group with the progress of the coupling reaction can be used to advantage in the present invention. As preferred examples of couplers capable of releasing a development inhibitor, that is to say, DIR couplers, mention may be made of those disclosed in the patents described in *Research Disclosure,* No. 17643 (Item VII-F) and *Research Disclosure,* No. 307105 (Item VII-F), JP-A-57-151944, JP-A-57-154234, JP-A-60-184248, JP-A-63-37346, JP-A-63-37350, and U.S. Pat. Nos. 4,248,962 and 4,782,012.

Preferred examples of couplers capable of releasing imagewise a nucleating agent or a development accelerator upon development are disclosed in British Patents 2,097,140 and 2,131,188, JP-A-59-157638 and JP-A-59-170840. Also, compounds capable of releasing a fogging agent, a development accelerator, a silver halide solvent or so on by the redox reaction with an oxidized product of a developing agent, as disclosed in JP-A-60-107029, JP-A-60-252340, JP-A-1-44940 and JP-A-1-45687, can be used to advantage.

Other compounds which can be used in the present invention include competing couplers as disclosed in U.S. Pat. No. 4,130,427, multiequivalent couplers as disclosed in U.S. Pat. Nos. 4,283,472, 4,338,393 and 4,310,618, DIR redox compound-releasing couplers, DIR coupler-releasing couplers, DIR coupler-releasing redox compounds or DIR redox compound-releasing redox compounds as disclosed in JP-A-60-185950 and JP-A-62-24252, couplers capable of releasing a dye which can recover its color after elimination as disclosed in EP-A-0173302, bleach accelerator-releasing couplers as disclosed in *Research Disclosure,* Nos. 11449 and 24241 and JP-A-61-201247, ligand-releasing couplers as disclosed in U.S. Pat. 4,555,477, leuco dye-releasing couplers as disclosed in JP-A-63-75747, fluorescent dye-releasing couplers as disclosed in U.S. Pat. 4,774,181, and so on.

Those couplers can be introduced into the photographic materials using various known dispersion methods, such as an oil-in-water dispersion method or a loadable latex dispersion method.

Examples of high boiling solvents which can be used in the oil-in-water dispersion method are described, for example, in U.S. Pat. No. 2,322,027. More specifically, high boiling organic solvents having a boiling point of 175° C. or higher under ordinary pressure which can be used in the oil-in-water dispersion method include phthalic acid esters (e.g., dibutyl phthalate, dicyclohexyl phthalate, di-2-ethylhexyl phthalate, decyl phthalate, bis(2,4-di-t-amylphenyl)phthalate, bis(2,4-di-t-amylphenyl)isophthalate, bis(1,1-diethylpropyl)phthalate), phosphoric or phosphonic acid esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate), benzoic acid esters (e.g., 2-ethylhexylbenzoate, dodecylbenzoate, 2-ethylhexyl-p-hydroxybenzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylic acid esters (e.g., bis(2-ethylhexyl)sebacate, dioctylazelate, glycerol tributyrate, isostearyl lactate, trioctyl citrate), aniline derivatives (e.g., N,N-dibutyl-2-butoxy-5-tertoctylaniline), hydrocarbones (e.g., paraffin, dodecylbenzene, diisopropylnaphthalene) and so on. In addition, organic solvents having a boiling point of from about 30° C., preferably about 50° C., to about 160° C. can be used as auxiliary solvent, with typical examples including ethyl acetate, butyl acetate, ethyl propionate, methyl ethyl ketone, cyclohexanone, 2-ethoxyethyl acetate, dimethylformamide, and so on.

As for the latex dispersion method, processes and effects thereof, and latexes used as impregnant are described specifically, for example, in U.S. Pat. No. 4,199,363, West German Patent Application (OLS) Nos. 2,541,274 and 2,541,230.

To the color photographic material of the present invention, it is desirable to add various kinds of antiseptics or antimolds such as phenethyl alcohol or 1,2-benzisothiazoline-3-one, n-butyl p-hydroxybenzoate, phenol, 4-chloro-3,5-dimethylphenol, 2-phenoxyethanol and 2-(4-thiazolyl)benzimidazole, as disclosed in JP-A-63-257747, JP-A-62-272248 and JP-A-1-80941.

The present invention can be applied to various kinds of color photographic materials. Typical examples include color negative films for general or cinematographic purposes, color reversal films for slide or television, color paper, color positive films, and color reversal paper.

Supports which can be properly used in the present invention are described, for example, in *Research Disclosure,* No. 17643 (page 28), and *Research Disclosure,* No. 18716 (from the right column on page 647 to the left column on page 648), and Research Disclosure, No. 307105 (page 879).

In the photographic material of the present invention, it is desirable that a total thickness of the whole hydrophilic colloid layers present on the side of their emulsion layers should be 28 μm or less, preferably 23 μm or less, more preferably 18 μm or less, and particularly preferably 16 μm or less. Further, the film swelling speed $T_{\frac{1}{2}}$ is preferably 30 seconds or less, more preferably 20 seconds or less. The term film thickness refers to the film thickness measured after 2 days' standing under the conditions of 25° C.-55% RH, and the film swelling speed $T_{\frac{1}{2}}$ is determined using manners known in the art. For example, the measurement can be made using a swellometer of the type described in A. Green et al., *Photgr. Sci. Eng.,* Vol. 19, No. 2, pages 124 to 129, and $T_{\frac{1}{2}}$ is defined as the time required to reach one-half the saturated film thickness which is taken as 90% of the maximum swollen film thickness attained when the film is processed with a color developer at 30° C. for 3 minutes 15 seconds.

The film swelling speed $T_{\frac{1}{2}}$ can be adjusted to a proper value by adding a hardener to gelatin as binder, or by changing the condition of preservation after coating. Additionally, the swelling degree is preferably from 150 to 400%. The swelling degree can be calculated from the maximum swollen film thickness determined under the above described condition, according to the following equation:

$$\frac{(\text{maximum swollen film thickness} - \text{film thickness})}{\text{film thickness}}$$

Moreover, it is desirable that the photographic material of the present invention should be provided with hydrophilic colloid layers having a total dry thickness of 2 to 20 μm on the opposite side of the emulsion layers (which are called backing layers). These backing layers preferably contain such additives as cited above, including a light absorber, a filter dye, an ultraviolet absorber, an antistatic agent, a hardener, a binder, a plasticizer, a lubricant, a coating aid, a surface active agent. The swelling degree of the whole backing layers ranges preferably from 150 to 500%.

The color photographic materials of the present invention can be development-processed using general methods described in the above cited *Research Disclosure,* No. 17643 (pages 28 and 29), *Research Disclosure,* No. 18716 (page 615, from left to right columns) and *Research Disclosure,* No. 307105 (pages 880 and 881).

A color developing solution which can be used for the development of the photographic material of the present invention is preferably an alkaline aqueous solution containing as a main component an aromatic primary amine type color developing agent. Those preferred as such a color developing agent are p-phenylenediamine compounds, though aminophenol compounds are also useful. Typical examples of p-phenylenediamine compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides or p-toluenesulfonates of the above cited anilines. Among these anilines, 3-methyl-4-amino-N-ethyl-N-β-hydroxyethylaniline sulfate is particularly preferred. These compounds can also be used as a mixture of two or more thereof, if desired.

In general, the color developing solution contains pH buffering agents such as carbonates, borates or phosphates of alkali metals, and development inhibitors or antifoggants such as chlorides, bromides, iodides, benzimidazoles, benzothiazoles or mercapto compounds. In addition, it can optionally contain various kinds of preservatives such as hydroxylamine, diethylhydroxylamine, sulfites, hydrazines such as N,N-biscarboxymethylhydrazine, phenylsemicarbazides, triethanolamine and catechol sulfonic acids; organic solvents such as ethylene glycol and diethylene glycol; development accelerators such as benzyl alcohol, polyethylene glycol, quaternary ammonium salts and amines; dye forming couplers; competing couplers; auxiliary developers such as 1-phenyl-3-pyrazolidone; viscosity imparting agents; various chelating agents represented by aminopolycarboxylic acids, aminopolyphosphonic acids, alkylphosphonic acids and phosphonocarboxylic acids (with specific examples including ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(ohydroxyphenylacetic acid), and salts of the above cited acids).

In the case where a reversal processing is carried out, a black-and-white development is generally performed prior to color development. In a black-and-white developing solution, known black-and-white developing agents, such as dihydroxybenzenes including hydroquinone, 3-pyrazolidones including 1-phenyl-3-pyrazolidone, or aminophenols including N-methyl-p-aminophenol, can be used individually or in combination.

The pH of such a color developing solution and a black-and-white developing solution is generally from 9 to 12. An amount of these developing solutions to be replenished, though depends on the kind of color photographic light-sensitive materials to be processed, is generally 3 liters or less per $m^2$ of the light-sensitive material processed therein. Also, it is feasible to reduce an amount of the replenisher to 500 ml or less by lowering the bromide ion concentration in the replenisher. When a replenisher is used in a reduced amount, it is desirable that evaporation and aerial oxidation of the developing solution should be prevented by reducing a contact area between air and the developing solution in the processing tank. Also, an amount of the replenisher to be used can be reduced by adopting a measure to inhibit the accumulation of bromide ion in the developing solution.

The contact area of air with a photographic processing solution in a processing tank can be represented by an opening ratio defined as follows:

$$\text{Opening Ratio} = \frac{\text{Contact area of processing solution with air (cm}^3\text{)}}{\text{Volume of processing solution (cm}^3\text{)}}$$

The opening ratio defined above is preferably controlled to 0.1 or less, more preferably from 0.001 to 0.05. In order to lower the opening ratio, not only a way of placing a shield, e.g., a floating cover, on the surface of a processing solution in a processing tank, but also a method of using a mobile cover as disclosed in JP-A-1-82033 and a slit development processing method as disclosed in JP-A-63-216050 can be adopted. It is to be desired that reduction of the opening ratio should be applied to every processing steps, including not only both color and black-and-white development processings but also those which succeed thereto, such as bleaching, bleach-fixing, fixing, washing and stabilizing.

Also, an amount of the replenisher can be reduced by adopting a measure to inhibit the accumulation of bromide ion in the developing solution.

A processing time for color development is generally within the range of 2 to 5 minutes, but can be more shortened by carrying out the processing under the condition of high temperature and high pH, and by using a developing agent in a high concentration.

Photographic emulsion layers are generally subjected to a bleach processing after the color development. The bleach processing may be carried out simultaneously with a fix processing (blix processing), or separately therefrom. In order to further increase a processing speed, a blix processing may be carried out after a bleach processing. Also, a processing may be carried out with two successive bleach-fix baths, a fix processing may be carried out before a blix processing, or a bleach processing may be carried out after a blix processing. That is, any manner may be employed in desilvering, if desired. Examples of a bleaching agent which can be used include compounds of polyvalent metals, such as Fe(III); peroxy acids; quinones; and nitro compounds. As representatives of such bleaching agents, Fe(III) complex salts of organic acids, for example, aminopolycarboxylic acids including ethylenediaminetetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid; citric acid; tartaric acid; and malic acid can be used. Among these bleaching agents, (aminopolycarbonato)iron(III) complex salts represented by (ethylenediaminetetraacetonato)iron(III) complex salts and 1,3-diaminopropanetetraacetonato)iron(III) complex are particularly favored from the viewpoints of rapid processing and prevention of environmental pollution. Additionally, (aminopolycarbonato)iron(III) complex salts are especially useful in both bleaching and bleach-fix baths. The bleaching or bleach-fix bath utilizing an (aminopolycarbonato)iron(III) complex is generally adjusted to a pH range 4.0 to 8.0. For the purpose of speedup of the processing, the processing may be carried out under pH values lower than the above described range.

In a bleaching bath, a bleach-fix bath and/or a prebath thereof, a bleach accelerator can be used, if needed. Specific examples of useful bleach accelerators include mercapto group- or disulfido linkage-containing compounds as disclosed, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure,* No. 17129 (July, 1978); thiazolidine derivatives disclosed in JP-A-50-140129; thiourea derivatives disclosed in JP-B-45-8506, JP-A-52-20832, JP-A-53-32735, and U.S. Pat. No. 3,706,561; iodides disclosed in West German Patent 1,127,715 and JP-A-58-16235; polyoxyethylene compounds disclosed in West German Patents 966,410 and 2,748,430; polyamine compounds disclosed in JP-B-45-8836; the compounds disclosed in JP-A-49-40943, JP-A-49-59644, JP-A-53-94927, JP-A-54-35727, JP-A-55-26506 and JP-A-58-163940; and bromide ion. Among these compounds, those containing a mercapto group or a disulfido linkage are favored over others because of their great effects upon bleach acceleration. In particular, the compounds disclosed in U.S. Pat. No. 3,893,858, West German Patent 1,290,812 and JP-A-53-95630 are preferred. In addition, the compounds disclosed in U.S. Pat. No. 4,552,834 are desirable, too. Bleach accelerators as cited above may be incorporated in photographic materials. In the bleach-fix processing of color photographic materials for photograph-taking use, such bleach accelerators as described above are especially effective.

Besides the inclusion of the above described compounds, the bleaching and the bleach-fix baths preferably contain organic acids for the purpose of prevention of bleach stain. Particularly favored organic acids are those having an acid dissociation constant (pKa) ranging from 2 to 5, with suitable examples including acetic acid, propionic acid, hydroxyacetic acid and the like.

As examples of a fixing agent which can be used in the fixer and the bleach-fix bath, mention may be made of thiosulfates, thiocyanates, thioether compounds, thioureas, and a large quantity of iodide. In general, thiosulfates are used as fixing agent. In particular, ammonium thiosulfate is most prevailingly used. Also, it is desirable to use a thiosulfate in combination with a thiocyanate, a thioether compound, a thiourea or so on. As preservatives for the fixer and the bleach-fix bath, sulfites, bisulfites, carbonyl-bisulfite adducts, or the sulfinic acid compounds disclosed in EP-A-0294769 are preferred. To the fixer and the bleach-fix bath, it is desirable for improvement in stability that aminopolycarboxylic acids and organophosphonic acids should be added.

Moreover, it is desirable for pH adjustment of the fixer and the bleach-fix bath that compounds having pKa within the range of 6.0 to 9.0, preferably imidazoles such as imidazole, 1-methylimidazole, 1-ethylimidazole, and 2-methylimidazole should be added in an amount of 0.1 to 10 mol/liter.

A shorter total period of time for desilvering process is preferred unless it causes insufficient desilvering. A preferred desilvering time ranges from 1 to 3 minutes, particularly from 1 to 2 minutes. On the other hand, a desilvering temperature is, in general, within the range of 25° C. to 50° C., preferably from 35° C. to 45° C. In the preferred temperature range, the desilvering speed is increased, and the desilvered materials can be effectively prevented from generating stains.

In the desilvering process, it is desirable that the stirring should be reinforced as greatly as possible. As for the method for strengthening the stirring force, there can be instanced the method disclosed in JP-A-62-183460 which involves making a jet stream of the processing solution come into collision with the emulsion surface of a photosensitive material; the method of enhancing a stirring effect by using the rotating means disclosed in JP-A-62-183461; the method of heightening a stirring effect by moving a photosensitive material while the emulsion surface thereof is kept in contact with wiper blades installed in the processing bath, thereby generating turbulent streams of the processing solution on the emulsion surface; and a method of increasing a rate of circulated flow of the processing solution as a whole. These means for heightening the stirring effect can be effectively applied to any of the bleach bath, the bleach-fix bath and the fixer. Improvement in stirring operation is considered to make it possible to promote supplies of bleaching and fixing agents into the emulsion films and, consequently, to increase a desilvering speed. Additionally, the above described means for heightening the stirring power become more effective when a bleach accelerator is used together, because not only the accelerating effect thereof can be remarkably heightened, but also an interferential action of the bleach accelerator upon fixation can be quenched.

Automatic developing machines which can be used for the photographic material of the present invention are preferably provided with a means for conveying photographic materials, such as those disclosed in JP-A-60-191257, JP-A-60-191258 and JP-A-60-191259. As described in the above cited JP-A-60-191257, the means of conveyance enables a considerable reduction in amount of the processing solution brought into the post bath from the prebath, whereby it can contribute to the prevention of deterioration in processability. This contribution is particularly effective in reducing processing time in each process and an amount of processing solution to be replenished.

After the desilvering processing, the silver halide color photographic material of the present invention is, in general, subjected to a washing and/or stabilization processing. A volume of washing water required in the washing processing can be set variously depending on the characteristics of photosensitive materials to be processed (for example, depending on the materials, such as couplers incorporated therein), end-use purposes of photosensitive materials to be processed, the temperature of washing water, the number of washing tanks (the number of stages), the way of replenishing washing water (as to, for example, whether a current of water flows in the counter direction, or not), and other various conditions. Of these conditions, the relation between the number of washing tanks and the volume of washing water in the multistage countercurrent process can be determined according to the methods described in *Journal of the Society of Motion Picture and Television Engineers,* Vol. 64, pages 248 to 253 (May, 1955).

According to the multistage countercurrent process described in the foregoing literature, a volume of washing water can be sharply decreased. However, the process has a disadvantage, for example, in that bacteria which have propagated themselves in the tanks because of an increase in staying time of water in the tanks produce a suspended matter, and the resulting suspended matter sticks to the photosensitive materials processed therein. As the means of solving such a problem as described above, the method of lowering calcium and magnesium ion concentrations, as disclosed in JP-A-62-288838, can be employed to great advantage. Further, bactericides such as isothiazolone compounds and thiabendazole compounds disclosed in JP-A-57-8542; chlorine-containing germicides such as sodium salt of chlorinated isocyanuric acid; and other germicides such as benzotriazoles, as described in Hiroshi Horiguchi, Bohkin-Bohbai-zai no Kagaku (Chemistry of Antibacterial Agents and Antimolds), Sankyo Shuppan (1986); Biseibutsu no Mekkin Sakkin Bohbai Gijutsu (Arts of Sterilizing and Pasteurizing Microbes, and Proofing against Molds), compiled by Eisei Gijutsukai, published by Kogyo Gijutsu Kai in 1982; and Bohkin-Bohbai-zai Jiten (Thesaurus of Antibacterial Agents and Antimolds), compiled by Nippon Bohkin Bohbai Gakkai (1986).

A suitable pH of the washing water in the processing of the photographic material of the present invention ranges from 4 to 9, more preferably from 5 to 8. The washing temperature and time, though can be chosen variously depending on the characteristics and the intended use of the photographic material to be processed, are within the range of 20 seconds to 10 minutes at temperatures from 15° C. to 45° C., preferably 30 seconds to 5 minutes at temperatures from 25° C. to 40° C.

Also, the photographic material of the present invention can be processed directly with a stabilizer instead of undergoing the above described washing processing. To such a stabilization processing, all of known methods as disclosed in JP-A-57-8543, JP-A-58-14834 and JP-A-60-220345 can be applied.

A stabilization processing may be carried out subsequently to the above described washing processing. For example, a stabilizing bath containing a dye stabilizing agent and a surface active agent can be used as the final bath of camera color photographic materials. Suitable examples of a dye stabilizing agent include aldehydes such as formaldehyde, glutaraldehyde, etc., N-methylol compounds, hexamethylenetetramine, and aldehyde-sulfite adducts. To this stabilizing bath also, various kinds of chelating agents, and antimolds can be added.

The solution overflowing the washing bath and/or the stabilizing bath in proportion to the replenishment can be reused in another processing step, such as a desilvering step.

When each of the above described processing solutions is concentrated by evaporation in the photographic processing which utilizes an automatic developing machine or the like, it is desirable to make concentration corrections by adding water.

In the silver halide color photographic material of the present invention, a color developing agent can be incorporated to simplify and speedup processing. In incorporating the color developing agent, it is desirable that it should be used in the form of precursor. As examples of such precursors, mention may be made of indoaniline compounds disclosed in U.S. Pat. No. 3,342,597, compounds of Schiff base type disclosed in U.S. Pat. No. 3,342,599, Research Disclosure, No. 14850 and *Research Disclosure,* No. 15159, aldol compounds disclosed in *Research Disclosure,* No. 13924, metal complexes disclosed in U.S. Pat. No. 3,719,492, and urethane compounds disclosed in JP-A-53-135628.

In the silver halide color photographic material of the present invention, various kinds of 1-phenyl-3-pyrazolidones may be incorporated for the purpose of promoting color development, if needed. Typical examples of such pyrazolidones are disclosed in JP-A-56-64339, JP-A-57-144547 and JP-A-58-115438.

Various kinds of processing solutions in the present invention are used in the temperature range of 10° to 50° C. Though a standard temperature is generally within the range of 33° C. to 38° C., temperatures higher than the above range can be chosen with the intention of reducing the processing time through acceleration of the processing, or those lower than the foregoing range can be chosen in order to achieve an improvement in image quality and enhancement of the stability of the processing bath.

Also, the silver halide photographic material of the present invention can be applied to heat developable photosensitive materials as disclosed in U.S. Pat. No. 4,500,626, JP-A-60-133449, JP-A-59-218443, JP-A-61-238056, EP-A2-0210660, and so on.

The present invention will now be illustrated in greater detail by reference to the following examples. However, the present invention should not be construed as being limited to these examples.

EXAMPLE 1

On a cellulose triacetate film support provided with a subbing layer was coated the following layers (1) and (2), in this order. The layer (1) had the composition described below, which comprised an emulsion prepared by dissolving one of the compounds of the present invention or the comparison compounds, as set forth in Table 1, together with a coupler (Cp-1) into tricresyl phosphate, and emulsifying them. The thus obtained photographic materials were named Samples 101 to 110.

| | |
|---|---|
| (1) Emulsion Layer: | |
| Silver Iodobromide Emulsion (having an average iodide content of 12 mol %, internal high AgI type, an average grain size of 1.2 μm, an aspect ratio of 7.0, and a variation coefficient of 18% with respect to grain size distribution) | 1.70 g/m$^2$ as Ag |
| Magenta Coupler (Cp-1) | 0.40 g/m$^2$ |
| Tricresyl phosphate | 0.35 g/m$^2$ |
| Compound of the Present Invention or Comparison Compound | Set Forth in Table 1 |
| Gelatin | 2.20 g/m$^2$ |
| (2) Protective Layer: | |
| Gelatin | 1.30 g/m$^2$ |
| Sodium 2,4-Dichloro-6-hydroxy-s-triazine | 0.10 g/m$^2$ |

After the thus prepared samples were allowed to stand for 16 hours under the conditions of 40° C. and 60% RH, they were exposed imagewise to white light with 40 lux.sec at the maximum. Then, the exposed samples each was subjected to the following photographic processing.

| | Processing Condition | | | |
|---|---|---|---|---|
| Processing Step | Time | Temperature (°C.) | Amount* Replenished (ml) | Tank Volume (l) |
| Color Development | 3 min 15 sec | 37.8 | 25 | 10 |
| Bleach | 45 sec | 38 | 5 | 4 |
| Bleach-Fix (1) | 45 sec | 38 | — | 4 |
| Bleach-Fix (2) | 45 sec | 38 | 30 | 4 |
| Washing (1) | 20 sec | 38 | — | 2 |
| Washing (2) | 20 sec | 38 | 30 | 2 |
| Stabilization | 20 sec | 38 | 20 | 2 |
| Drying | 1 min | 55 | | |

*per 1 m long by 35 mm wide

The bleach-fix and the washing steps were each carried out according to two-stage countercurrent process in which the current of each processing solution flew from the bath (2) to the bath (1). All the solution overflowing the bleaching bath was introduced to the bleach-fix bath (2).

Additionally, the amount of the bleach-fix solution carried over into the washing bath by the photographic material 35 w wide was 2 ml per m.

| | Tank Solution | Replenisher |
|---|---|---|
| Color Developer: | | |
| Diethylenetriaminepentaacetic Acid | 5.0 g | 6.0 g |
| Sodium Sulfite | 4.0 g | 5.0 g |
| Potassium Carbonate | 30.0 g | 37.0 g |
| Potassium Bromide | 1.3 g | 0.5 g |
| Potassium Iodide | 1.2 ml | — |
| Hydroxylamine Sulfate | 2.0 g | 3.6 g |
| 4-(N-Ethyl-N-β-hydroxyethylamine)-2-methylaniline Sulfate | 4.7 g | 6.2 g |
| Water to make | 1.0 l | 1.0 l |
| pH | 10.00 | 10.15 |
| Bleaching Bath: | | |
| Ammonium 1,3-Diaminopropanetetraacetatoferrate(III) Monohydrate | 144.0 g | 206.0 g |
| 1,3-Diaminopropanetetraacetic Acid | 2.8 g | 4.0 g |

-continued

| | Tank Solution | Replenisher |
|---|---|---|
| Ammonium Bromide | 84.0 g | 120.0 g |
| Ammonium Nitrate | 17.5 g | 25.0 g |
| Aqueous Ammonia (27%) | 10.0 g | 1.8 g |
| Acetic Acid (98%) | 51.1 g | 73.0 g |
| Water to make | 1.0 l | 1.0 l |
| pH | 4.3 | 3.4 |
| Bleach-Fix Bath: | | |
| Ammonium Ethylenediaminetetra-acetatoferrate(III) Dehydrate | 50.0 g | — |
| Disodium Ethylenediaminetetra-acetate | 5.0 g | 25.0 g |
| Ammonium Sulfite | 12.0 g | 20.0 g |
| Aqueous Ammonium Thiosulfate (700 g/liter) | 290.0 ml | 320.0 ml |
| Aqueous Ammonia (27 wt %) | 6.0 ml | 15.0 ml |
| Water to make | 1.0 l | 1.0 l |
| PH | 6.8 | 8.0 |

Washing Bath (Tank solution=Replenisher):

City water was passed through a column of mixed bed system in which H-type strongly acidic cation exchange resin (Amberlite IR-120B, produced by Rhom & Haas Co.) and OH-type strongly basic anion exchange resin (Amberlite IR-400, produced by Rhom & Haas Co.) were charged, resulting in reduction of calcium and magnesium ion concentrations each to 3 mg/liter or less. To the thus purified water were added 20 mg/liter of sodium dichloroisocyanurate and 150 mg/liter of sodium sulfate. The pH of the resulting solution was within the range of 6.5 to 7.5.

| Stabilizing Bath (Tank solution = Replenisher): | |
|---|---|
| Formaldehyde (37 wt %) | 1.2 ml |
| Surface Active Agent $[C_{10}H_{21}—O—(CH_2CH_2O)_{10}H]$ | 0.4 g |
| Ethylene Glycol | 1.0 g |
| Water to make | 1.0 liter |
| pH | 5.0–7.0 |

The results of examining these processed samples for photographic characteristics are shown in Table 1.

TABLE 1

| Sample | Compound Kind | Compound Amount (mol/m²) | Fog | Gamma[1)] | Relative Sensitivity[2)] |
|---|---|---|---|---|---|
| 101 (Comparison) | — | — | 0.24 | 1.05 | 0 |
| 102 (Invention) | (1) | $5 \times 10^{-6}$ | 0.14 | 1.16 | 0.03 |
| 103 (Invention) | (28) | " | 0.17 | 1.10 | 0.02 |
| 104 (Invention) | (35) | " | 0.15 | 1.14 | 0.03 |
| 105 (Comparison) | R-1 | " | 0.28 | 1.13 | −0.04 |
| 106 (Comparison) | R-2 | $1 \times 10^{-5}$ | 0.29 | 1.16 | −0.06 |
| 107 (Comparison) | R-3 | $5 \times 10^{-6}$ | 0.27 | 1.20 | −0.07 |
| 108 (Comparison) | R-4 | $1 \times 10^{-5}$ | 0.18 | 1.14 | 0.00 |
| 109 (Comparison) | R-5 | " | 0.25 | 1.12 | −0.04 |
| 110 (Comparison) | R-6 | " | 0.20 | 1.17 | −0.01 |

[1)]The slope of a straight line formed by connecting the density point (fog + 0.2) and the density point (fog + 0.5).

[2)]The cologarithm of exposure yielding the density (fog + 0.2), shown relatively with Sample 101 being taken as 0.

TABLE 1-continued

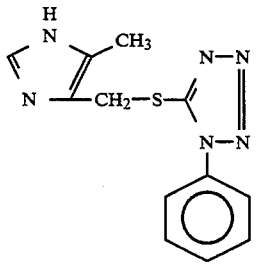

R-1 (Compound (II) in JP-A-59-225168)

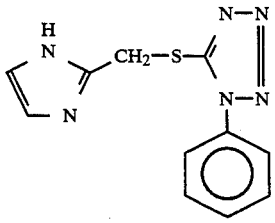

R-2 (Compound (XIV) in JP-A-59-225168)

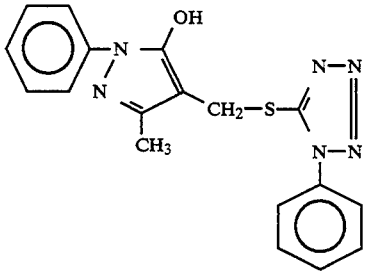

R-3 (Compound (1) in U.S. Pat. No. 4,421,845)

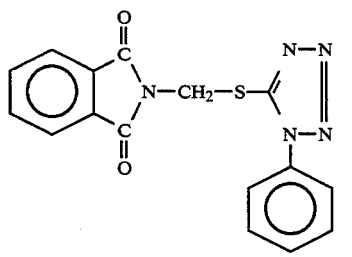

R-4 (Compound shown as Example 1 in JP-A-57-135949)

R-5 (Compound shown as Example 1 in JP-A-59-3434)

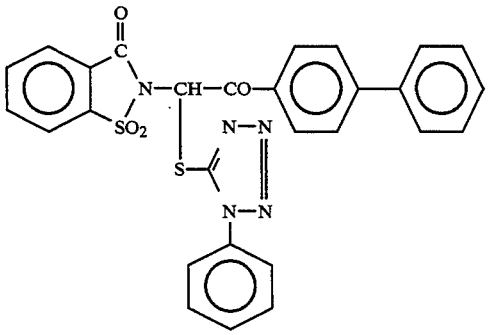

R-6 (Compound (1) in JP-A-60-41034)

TABLE 1-continued

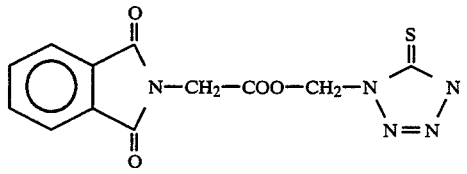

It can be clearly seen from Table 1 that while all the samples containing the precursor compound of the present invention were low in fog density and high in contrast and sensitivity, some of samples for comparison had low sensitivity and/or high fog density, and some were able to have a satisfactory effect only when precursor compounds were added in increased amounts.

EXAMPLE 2

Samples from 201 to 206 were prepared in the same manner as Sample 101, except that the compounds set forth in Table 2 were incorporated in the emulsion layer, respectively. Each was subjected to the same exposure as in Example 1, and then to the following color photographic processing.

The results are shown in Table 2.

It can be clearly seen from Table 2 that addition of the precursor compounds of the present invention enabled the photographic materials to acquire high sensitivity and high contrast even in rapid processing.

| Processing Step | Processing Condition: Processing Time | Processing Temperature (°C.) |
|---|---|---|
| Color Development | 1 min 45 sec | 38 |
| Bleach | 1 min 00 sec | 38 |
| Bleach-Fix | 3 min 15 sec | 38 |
| Washing (1) | 40 sec | 35 |
| Washing (2) | 1 min 00 sec | 35 |
| Stabilization | 40 sec | 38 |
| Drying | 1 min 15 sec | 55 |

The composition of each processing bath used was described below.

| | |
|---|---|
| Color Developer: | |
| Diethylenetriaminepentaacetic Acid | 1.0 g |
| 1-Hydroxyethylidene-1,1-diphosphonic Acid | 3.0 g |
| Sodium Sulfite | 4.0 g |
| Potassium Carbonate | 30.0 g |
| Potassium Bromide | 1.4 g |
| Potassium Iodide | 1.5 mg |
| Hydroxylamine Sulfate | 2.4 g |
| 4-(N-Ethyl-N-β-hydroxyethylamine)-2-methylaniline Sulfate | 4.5 g |
| Water to make | 1.0 liter |
| pH | 10.15 |
| Bleaching Bath: | |
| Ammonium Ethylenediaminetetraacetato-ferrate (III) Dihydrate | 120.0 g |
| Disodium Ethylenediaminetetraacetate | 10.0 g |
| Ammonium Bromide | 100.0 g |
| Ammonium Nitrate | 10.04 g |
| Bleach Accelerator | 0.005 mol |

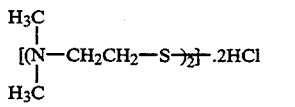

-continued

| | |
|---|---|
| Aqueous Ammonia (27%) | 15.0 ml |
| Water to make | 1.0 liter |
| pH | 6.3 |
| Bleach-Fix Bath: | |
| Ammonium Ethylenediaminetetraacetato-ferrate (III) Dihydrate | 50.0 g |
| Disodium Ethylenediaminetetraacetate | 5.0 g |
| Ammonium Sulfite | 12.0 g |
| Aqueous Ammonium Thiosulfate (70 wt %) | 240.0 ml |
| Aqueous Ammonia (27 wt %) | 6.0 ml |
| Water to make | 1.0 liter |
| pH | 7.2 |

Washing Bath:

City water was passed through a column of mixed bed system in which H-type strongly acidic cation exchange resin (Amberlite IR-120B, produced by Rhom & Haas Co.) and OH-type anion exchange resin (Amberlite IR-400, produced by Rhom & Haas Co.) were charged, resulting in reduction of calcium and magnesium ion concentrations to 3 mg/liter or less. To the thus purified water were added 20 mg/liter of sodium dichloroisocyanurate and 0.15 g/liter of sodium sulfate. The pH of the resulting solution was within the range of 6.5 to 7.5.

| Stabilizing Bath: | |
|---|---|
| Formaldehyde (37 wt %) | 2.0 ml |
| Polyoxyethylene-p-monononylphenyl-ether (average polymerization degree: 10) | 0.3 g |
| Disodium Ethylenediaminetetraacetate | 0.05 g |
| Water to make | 1.0 liter |
| pH | 5.0–8.0 |

TABLE 2

| Sample | Compound: Kind | Compound: Amount (mol/m²) | Fog | Gamma | Relative Sensitivity |
|---|---|---|---|---|---|
| 101 (Comparison) | — | — | 0.07 | 0.56 | 0.00 |
| 102 (Invention) | (24) | $2 \times 10^{-4}$ | 0.09 | 0.95 | 0.16 |
| 103 (Invention) | (25) | " | 0.08 | 0.84 | 0.13 |
| 104 (Invention) | (26) | " | 0.09 | 0.91 | 0.14 |

EXAMPLE 3

Each of Compounds (19) and (20) of the present invention was incorporated so as to have a coverage of 0.0040 g/m² in each light-sensitive layer of Sample 1 prepared in Example 1 of JP-A-2-90145, and the resulting samples were subjected to the same photographic processing. Thereby, satisfactory Dmax and Dmin were achieved.

While the invention has been described in detail and with reference to specific embodiments thereof, it will be apparent to one skilled in the art that various changes and modifications can be made therein without departing from the spirit and scope thereof.

What is claimed is:

1. A silver halide photographic material having on a support at least one silver halide emulsion layer, which contains at least one compound which is according to the following formula (I) and which is of the kind which releases at least two photographically useful groups, which are attached, either directly or through $L_1$, to different constituent atoms of $L_2$:

$$Q-(L_1)_l-(L_2)_m-[(L_1)_n-PUG]_s \quad (I)$$

wherein Q represents a hydrogen atom or an alkali-eliminable group which does not react with an oxidized product of a developing agent, or reacts therewith more slowly than a hydrolytic reaction of said alkali-eliminable group with an alkali; $L_1$ represents a divalent timing group; $L_2$ represents a timing group having a valence of 3 or more; PUG represents a photographically useful group; l and n each represents 1, 1 or 2; m represents 1 or 2; and s represents a number obtained by subtracting 1 from the valence of $L_2$, being an integer of at least 2; and when a plurality of $L_1$ groups or a plurality of $L_2$ groups are present in a molecule, they may be the same or different; and the plurality of PUG groups may be the same or different.

2. A silver halide photographic material as in claim 1, wherein said photographically useful groups are selected from the group consisting of a residue of each of a development inhibitor, dye, fogging agent, developer, coupler, development accelerator, desilvering accelerator, bleach accelerator and fixing accelerator.

3. A silver halide photographic material as in claim 1, wherein $L_1$ is represented by formulae (T-1), (T-2), (T-3), (T-4), (T-5) or (T-6):

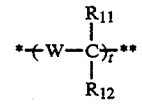

(T-1)

wherein * indicates the position at which Q, $L_1$ or $L_2$ of the compound represented by formula (I) is bonded; and ** indicates the position at which $L_1$, $L_2$ or PUG is bonded; W represents an oxygen atom, a sulfur atom, or an

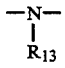

group; $R_{11}$ and $R_{12}$ each represents a hydrogen atom or a substituent group; $R_{13}$ represents a substituent group; and t represents 1 or 2; and when t is 2, the two

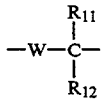

groups may be the same or different;

$$*-Nu-Link-E-** \quad (T\text{-}2)$$

wherein Nu represents a nucleophilic group; E represents an electrophilic group, being a group which is subjected to nucleophilic attack by Nu and with which the bond marked ** can be cleaved; and Link represents a linking group which enables Nu and E to have a steric arrangement such that an intramolecular nucleophilic substitution reaction can occur;

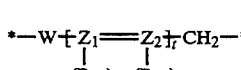

(T-3)

wherein *, **, W, $R_{11}$, $R_{12}$ and t all have the same meaning as described above in connection with formula (T-1); $R_{11}$ and $R_{12}$ may be joined together to form a benzene ring or a structural part of a heterocyclic ring; or $R_{11}$ and $R_{12}$ and W may be joined together to form a benzene ring or a heterocyclic ring; $Z_1$ and $Z_2$ each independently represents a carbon atom or a nitrogen atom; and x and y represent 0 or 1; when t is 2, the two

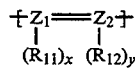

groups may be the same or different;

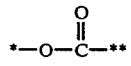

(T-4)

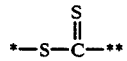

(T-5)

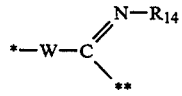

(T-6)

wherein * and ** in (T-4), (T-5) and (T-6) have the same meaning as in formula (T-1); in formula (T-6) W have the same meaning as in connection with formula (T-1); and $R_{14}$ has the same meaning as $R_{13}$.

4. A silver halide photographic material as in claim 1, wherein $L_2$ represents an electron transfer type timing group having a valence of at least 3.

5. A silver halide photographic material as in claim 1, wherein $L_2$ is represented by formula (T-$L_2$):

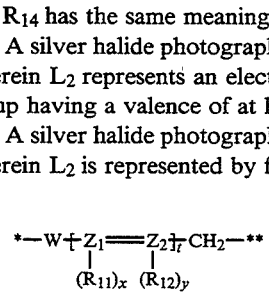

(T-$L_2$)

wherein W represents an oxygen atom, a sulfur atom or an

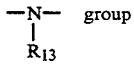

group (wherein $R_{13}$ represents a substituent group); each represents a hydrogen atom or a substituent group; $Z_1$ and $Z_2$each independently represents a carbon atom or a nitrogen atom, x and y each represents 0 or 1; t represents 1 or 2; * indicates the position at which Q-$(L_1)_l$— in formula (I) is bonded, and ** indicates the position at which —$(L_1)_n$—PUG in formula (I) is bonded and at least one of the plurality of $R_{11}$ or $R_{12}$ groups is bonded to —$(L_1)_n$—PUG with a substituted or unsubstituted methylene group.

6. A silver halide photographic material as in claim 1, wherein the photographically useful group is a residue of a development inhibitor.

7. A silver halide photographic material as in claim 6, wherein the development inhibitor is represented by formulae (INH-1) to (INH-13):

(INH-1)

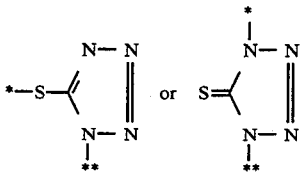

(INH-2)

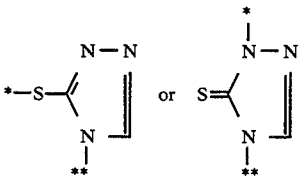

(INH-3)

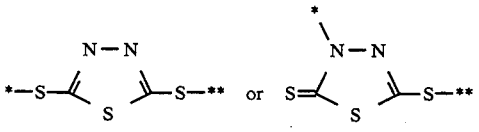

(INH-4)

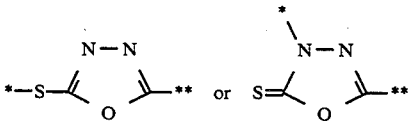

(INH-5)

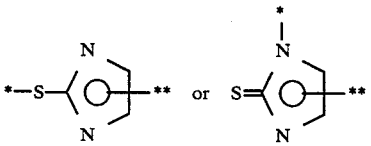

(INH-6)

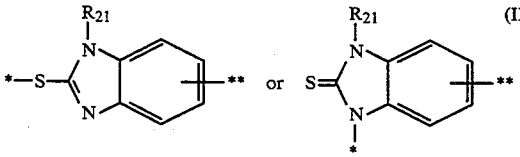

(INH-7)

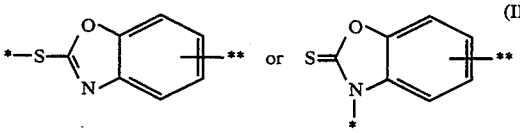

-continued (INH-8)

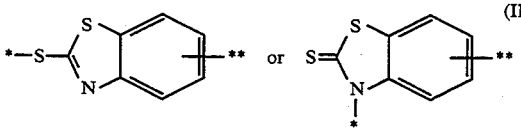

(INH-9)

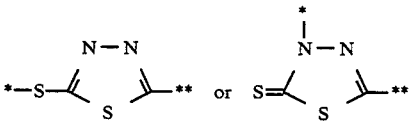

(INH-10)

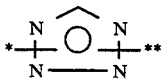

(INH-11)

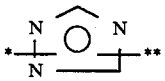

(INH-12)

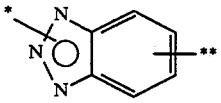

(INH-13)

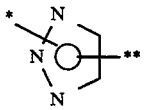

wherein $R_{21}$ represents a hydrogen atom, or a substituted or unsubstituted hydrocarbon group; * indicates the position at which the group represented by $L_1$ or $L_2$ of the compound represented by formula (I) is bonded; and ** indicates the position at which a substituent group is bonded.

8. A silver halide photographic material as in claim 1, wherein the photographically useful group is selected from residues of a development inhibitor and of a fogging agent and the compound of formula I is present in an amount of from $1\times10^{-7}$ to $1\times10^{-2}$ mol/m$^2$.

9. A silver halide photographic material as in claim 1, wherein the photographically useful group is selected from residues of a development accelerator, desilvering accelerator and developer and the compound of formula I is present in an amount of from $5\times10^{-7}$ to $2\times10$ mol/m$^2$.

10. A silver halide photographic material as in claim 1, wherein the photographically useful group is a residue of a dye and the compound of formula I is present in an amount of from $1\times10^{-6}$ to $3\times10^{-2}$ mol/m$^2$.

* * * * *